US010907228B2

(12) United States Patent
Verma

(10) Patent No.: US 10,907,228 B2
(45) Date of Patent: Feb. 2, 2021

(54) METHODS OF MODIFYING MATERIAL PROPERTIES OF WORKPIECES USING HIGH-PRESSURE-TORSION APPARATUSES

(71) Applicant: The Boeing Company, Chicago, IL (US)

(72) Inventor: Ravi Verma, Chesterfield, MO (US)

(73) Assignee: The Boeing Company, Chicago, IL (US)

( * ) Notice: Subject to any disclaimer, the term of this patent is extended or adjusted under 35 U.S.C. 154(b) by 217 days.

(21) Appl. No.: 16/227,543

(22) Filed: Dec. 20, 2018

(65) Prior Publication Data

US 2020/0199701 A1 Jun. 25, 2020

(51) Int. Cl.
*C21D 1/84* (2006.01)
*C21D 7/13* (2006.01)
(Continued)

(52) U.S. Cl.
CPC ..... *C21D 1/84* (2013.01); *C21D 1/613* (2013.01); *C21D 1/673* (2013.01); *C21D 7/13* (2013.01);
(Continued)

(58) Field of Classification Search
CPC ..... C21D 1/613; C21D 1/673; C21D 1/84; C21D 2221/00; C21D 7/13; C21D 8/06;
(Continued)

(56) References Cited

U.S. PATENT DOCUMENTS 4,437,329 A * 3/1984 Geppelt ..... B21D 11/14 72/299
7,115,177 B2 * 10/2006 Appel ..... B21J 1/025 148/639
(Continued)

FOREIGN PATENT DOCUMENTS

EP 1214995 A2 6/2002
EP 1570924 B1 8/2009
JP 2009131884 A 6/2009

OTHER PUBLICATIONS

Azushima, A. et al.; Severe Plastic Deformation (SPD) Processes for Metals; CIRP Annals—Manufacturing Technology 57 (2008), pp. 716-735.
(Continued)

*Primary Examiner* — Scott R Kastler
*Assistant Examiner* — Michael Aboagye
(74) *Attorney, Agent, or Firm* — Kwan & Olynick LLP

(57) ABSTRACT

Described is a method of modifying material properties of a workpiece using a high-pressure-torsion apparatus, comprising a working axis, a first anvil, a second anvil, and an annular body, comprising a first conductive chiller, a second conductive chiller, and a heater, positioned between the first conductive chiller and the second conductive chiller along the working axis. The method comprises compressing the workpiece along a central axis of the workpiece and, simultaneously with compressing the workpiece alone the central axis, twisting the workpiece about the central axis. The method further comprises, while compressing the workpiece
(Continued)

along the central axis and twisting the workpiece about the central axis, translating the annular body along the working axis of the high-pressure-torsion apparatus, collinear with the central axis of the workpiece, and heating the workpiece with the heater.

20 Claims, 15 Drawing Sheets

(51) Int. Cl.

| | |
|---|---|
| ***C21D 1/613*** | (2006.01) |
| ***C21D 1/673*** | (2006.01) |
| ***C21D 8/06*** | (2006.01) |
| ***C21D 9/00*** | (2006.01) |

(52) U.S. Cl.
CPC ..... *C21D 8/06* (2013.01); *C21D 9/0075* (2013.01); *C21D 2201/05* (2013.01); *C21D 2221/00* (2013.01)

(58) Field of Classification Search
CPC ..... C21D 9/0075; B21D 11/14; B21D 11/22; B21J 1/003; B21J 1/02; B21J 1/025
USPC ..... 148/558, 714, 302, 294, 639, 670, 671, 148/643, 640; 72/64, 342.5, 342.94, 710, 72/248, 371
See application file for complete search history.

(56) References Cited

U.S. PATENT DOCUMENTS 7,559,221 B2 * 7/2009 Horita ..... B21J 1/025 72/342.6
8,394,214 B2 * 3/2013 Nakamura ..... C22F 1/00 148/559

OTHER PUBLICATIONS

European Application Serial No. 19200310.1, Search Report dated May 4, 2020, 6 pgs.
European Application Serial No. 19200600.5, Search Report dated Apr. 17, 2020, 6 pgs.
European Application Serial No. 19200602.1, Search Report dated Apr. 20, 2020, 6 pgs.
Edalati, Kaveh et al., "A review on high-pressure torsion (HPT) from 1935 to 1988", Materials Science and Engineering A 652, 2016, pp. 325-352.
Hohenwarter, A. , "Incremental high pressure torsion as a novel severe plastic deformation process: Processing features and application to copper", Materials Science and Engineering A 626, 2015, pp. 80-85.
Verma, Ravi , "High-Pressure-Torsion Apparatuses and Methods of Modifying Material Properties of Workpieces Using Such Apparatuses", U.S. Appl. No. 16/227,516, filed Dec. 20, 2018, 95 pgs.
Verma, Ravi , "High-Pressure-Torsion Apparatuses and Methods of Modifying Material Properties of Workpieces Using Such Apparatuses", U.S. Appl. No. 16/227,531, filed Dec. 20, 2018, 101 pgs.

* cited by examiner

*(Continued to FIG. 7B)*

METHODS OF MODIFYING MATERIAL PROPERTIES OF WORKPIECES USING HIGH-PRESSURE-TORSION APPARATUSES

BACKGROUND

High-pressure torsion is a technique, used to control grain structures in workpieces. However, requirements for high pressure and high torque have limited this technique to workpieces, having specific geometric constraints—for example, disks, having thicknesses of about 1 millimeter or less. Such workpieces have limited practical applications, if any. Moreover, scaling the workpiece size proved to be difficult. Incremental processing of elongated workpieces has been proposed, but has not been successfully implemented.

SUMMARY

Accordingly, apparatuses and methods, intended to address at least the above-identified concerns, would find utility.

The following is a non-exhaustive list of examples, which may or may not be claimed, of the subject matter, disclosed herein.

One example of the subject matter, disclosed herein, relates to a high-pressure-torsion apparatus, comprising a working axis, a first anvil, a second anvil, and an annular body. The second anvil faces the first anvil and is spaced apart from the first anvil along the working axis. The first anvil and the second anvil are translatable relative to each other along the working axis. The first anvil and the second anvil are rotatable relative to each other about the working axis. The annular body comprises a first conductive chiller, a second conductive chiller, and a heater. The first conductive chiller is translatable between the first anvil and the second anvil along the working axis. The first conductive chiller is configured to be thermally conductively coupled with a workpiece that has a surface and a central axis, collinear with the working axis. The first conductive chiller is configured to selectively cool the workpiece. The second conductive chiller is translatable between the first anvil and the second anvil along the working axis. The second conductive chiller is configured to be thermally conductively coupled with the workpiece. The second conductive chiller is configured to selectively cool the workpiece. The heater is positioned between the first conductive chiller and the second conductive chiller along the working axis. The heater is translatable between the first anvil and the second anvil along the working axis and is configured to selectively heat the workpiece.

High-pressure-torsion apparatus 100 is configured to process workpiece 190 by heating a portion of workpiece 190 while applying the compression and torque to workpiece 190 to this heated portion. By heating only the portion of workpiece 190, rather than heating and processing workpiece 190 in its entirety at the same time, all of high-pressure-torsion deformation is confined to the narrow heated layer only, imparting high strains needed for fine-grain development. This reduction in compression and torque translates into a design of high-pressure-torsion apparatus 100 that is less complex and costly. Furthermore, this reduction in compression and torque results in more precise control over processing parameters, such as temperature, compression load, torque, processing duration, and the like. As such, more specific and controlled material microstructures of workpiece 190. For example, ultrafine grained materials offer substantial advantage over coarser grained materials displaying higher strength and better ductility. Finally, high-pressure-torsion apparatus 100 is able to process workpiece 190 having much large dimensions, e.g., a length, extending along working axis 102 of high-pressure-torsion apparatus 100, than would otherwise be possible if workpiece 190 is processed in its entirety at the same time.

A stacked arrangement of first conductive chiller 140, heater 160, and second conductive chiller 150 allows controlling the size and position of each processed portion of workpiece 190. A processed portion generally corresponds to a heated portion, defined, at least in part, by the position of heater 160 relative to workpiece 190 and the heating output of heater 160. While the compression and torque is applied to workpiece 190 in its entirety, the modification of material properties primarily happens in the heated portion. More specifically, the modification happens in a processed portion, which has a temperature within a desired processing range, which is defined as operating temperature zone 400.

When first conductive chiller 140 and/or second conductive chiller 150 are operational, the heated portion of workpiece 190 is adjacent to a first cooled portion and/or a second cooled portion. The first cooled portion is defined, at least in part, by the position of first conductive chiller 140 relative to workpiece 190 and the cooling output of first conductive chiller 140. The second cooled portion is defined, at least in part, by the position of second conductive chiller 150 relative to workpiece 190 and the cooling output of second conductive chiller 150. The first cooled portion and/or the second cooled portion are used to control the internal heat transfer within workpiece 190, thereby controlling some characteristics of the processed portion and the shape of operating temperature zone 400, shown in FIGS. 4A-4C.

First conductive chiller 140, heater 160, and second conductive chiller 150 are translatable along working axis 102 to process different portions of workpiece 190, along central axis 195 of workpiece 190 defining the length of workpiece 190. As a result, high-pressure-torsion apparatus 100 is configured to process workpiece 190 with a large length relative to conventional pressure-torsion techniques, e.g., when workpiece 190 is processed in its entirety.

Another example of the subject matter, disclosed herein, relates to a method of modifying material properties of a workpiece using a high-pressure-torsion apparatus. The high-pressure-torsion apparatus comprises a working axis, a first anvil, a second anvil, and an annular body. The annular body comprises a first conductive chiller, a second conductive chiller, and a heater, positioned between the first conductive chiller and the second conductive chiller along the working axis. The method comprises compressing the workpiece along a central axis of the workpiece. The method also comprises, simultaneously with compressing the workpiece along the central axis, twisting the workpiece about the central axis. The method further comprises, while compressing the workpiece along the central axis and twisting the workpiece about the central axis, translating the annular body along the working axis of the high-pressure-torsion apparatus, collinear with the central axis of the workpiece, and heating the workpiece with the heater. The method additionally comprises cooling the workpiece with at least one of the first conductive chiller or the second conductive chiller, simultaneously with heating the workpiece.

Method 800 utilizes a combination of compression, torque, and heat applied to a portion of workpiece 190, rather than workpiece 190 in its entirety. By heating only the portion of workpiece 190, rather than heating and processing workpiece 190 in its entirety at the same time, all of high-pressure-torsion deformation is confined to the narrow heated layer only, imparting high strains needed for fine-grain development. This reduction in compression and torque translates into a design of high-pressure-torsion apparatus 100 that is less complex and costly. Furthermore, this reduction in compression and torque results in more precise control over processing parameters, such as temperature, compression load, torque, processing duration, and the like. As such, more specific and controlled material microstructures of workpiece 190. For example, ultrafine grained materials offer substantial advantage over coarser grained materials displaying higher strength and better ductility. Finally, high-pressure-torsion apparatus 100 is able to process workpiece 190 having much large dimensions, e.g., a length, extending along working axis 102 of high-pressure-torsion apparatus 100, than would otherwise be possible if workpiece 190 were processed in its entirety at the same time.

A processed portion generally corresponds to a heated portion, defined, at least in part, by the position of heater 160 relative to workpiece 190 and the heating output of heater 160. While the compression and torque is applied to workpiece 190 in its entirety, the modification of material properties primarily happens in the heated portion. More specifically, the modification happens in a processed portion, which has a temperature within a desired processing range, which is defined as operating temperature zone 400.

A combination of heater 160 and one or both of first conductive chiller 140 and second conductive chiller 150 allows controlling the size and position of each processed portion, defined by operating temperature zone 400. When heater 160 selective heats a portion of workpiece 190, workpiece 190 experiences internal heat transfer, away from the heated portion. Cooling one or both adjacent portions of workpiece 190 allows controlling the effects of this internal heat transfer.

BRIEF DESCRIPTION OF THE DRAWINGS

Figure 1A:
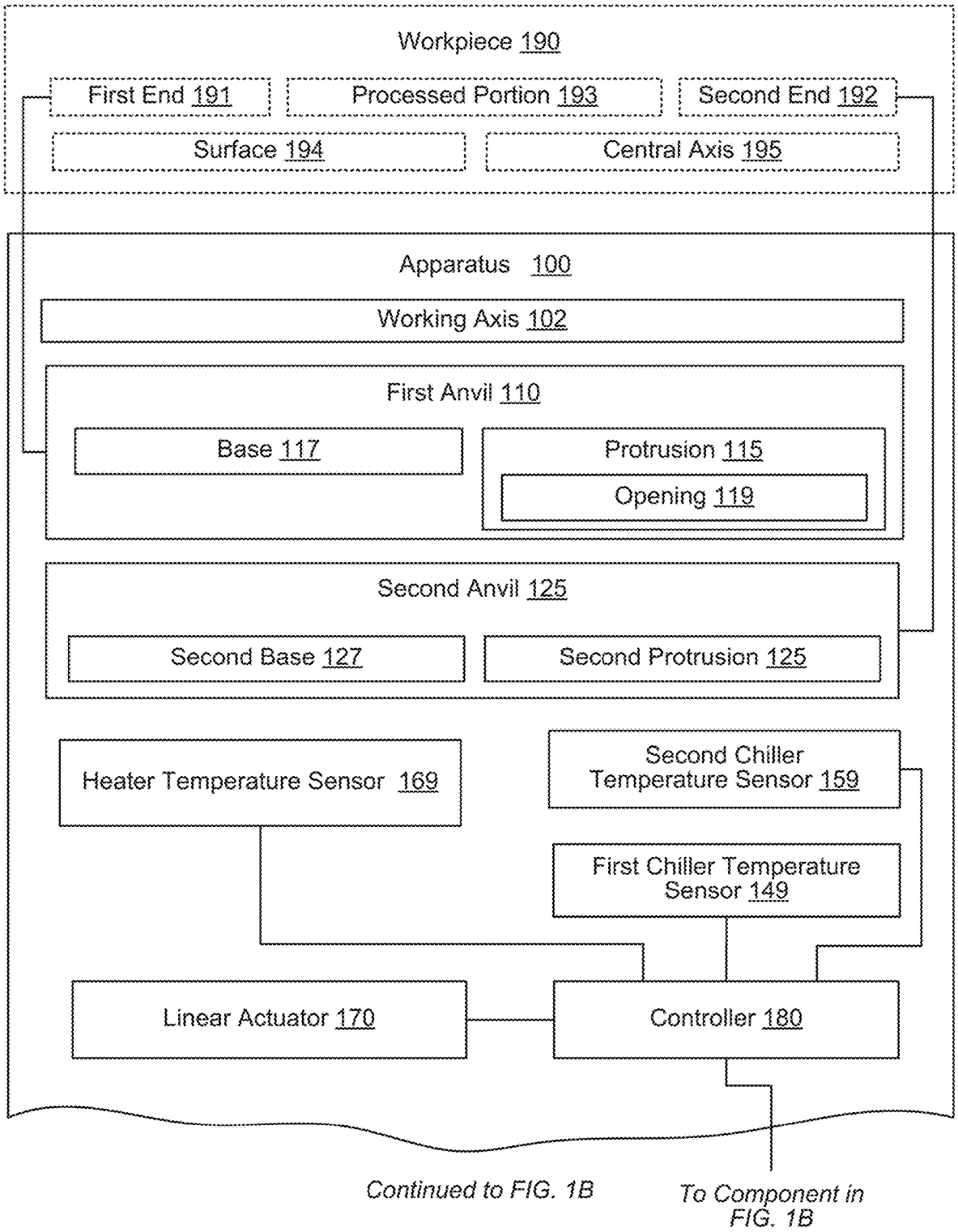
Figure 1B:
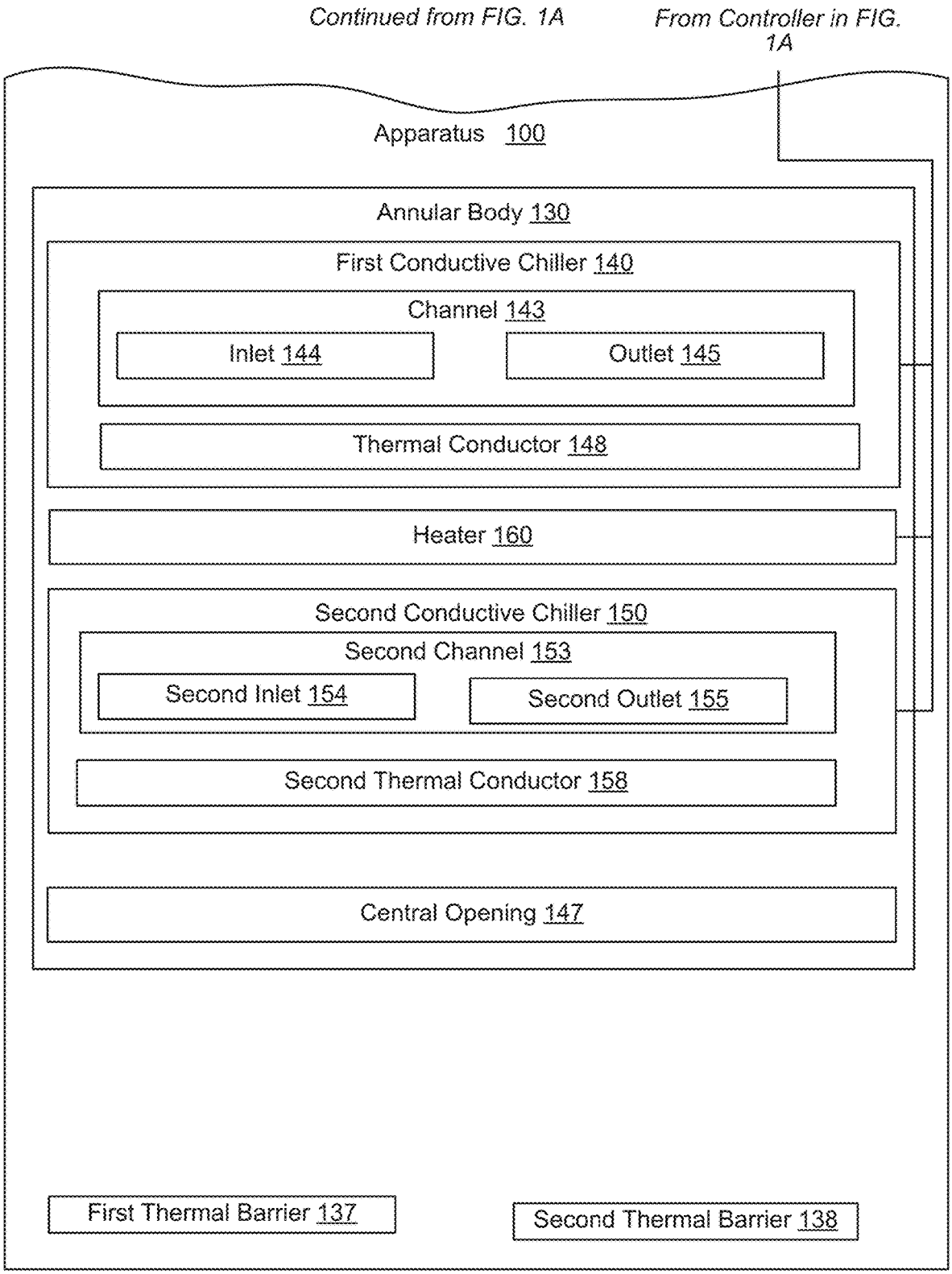
Figure 2A:
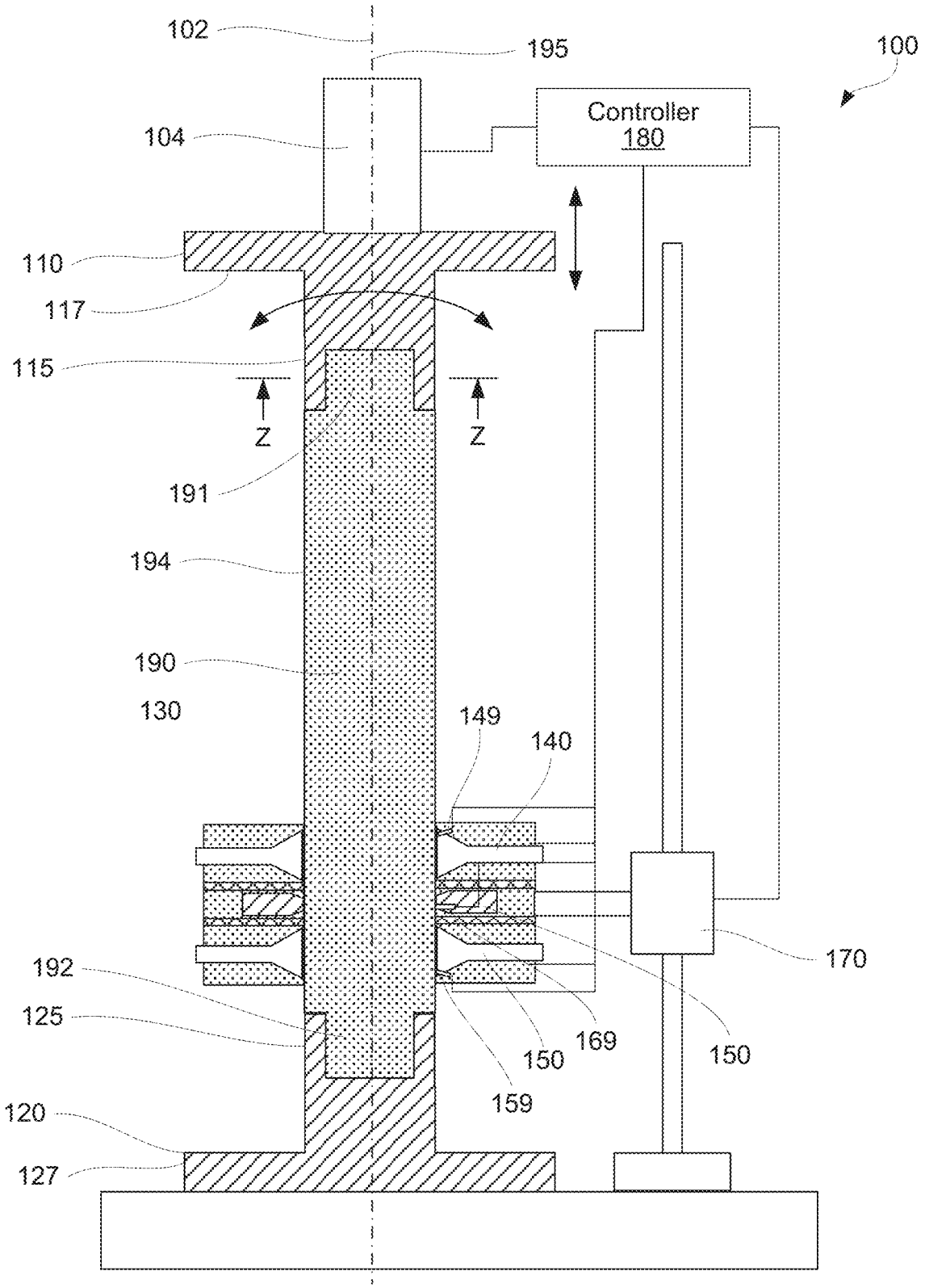
Figure 2B:
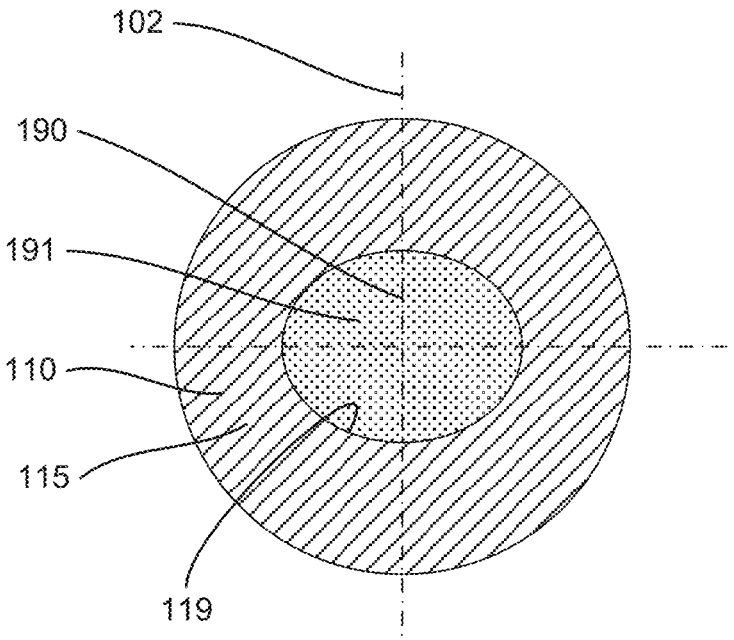
Figure 2C:
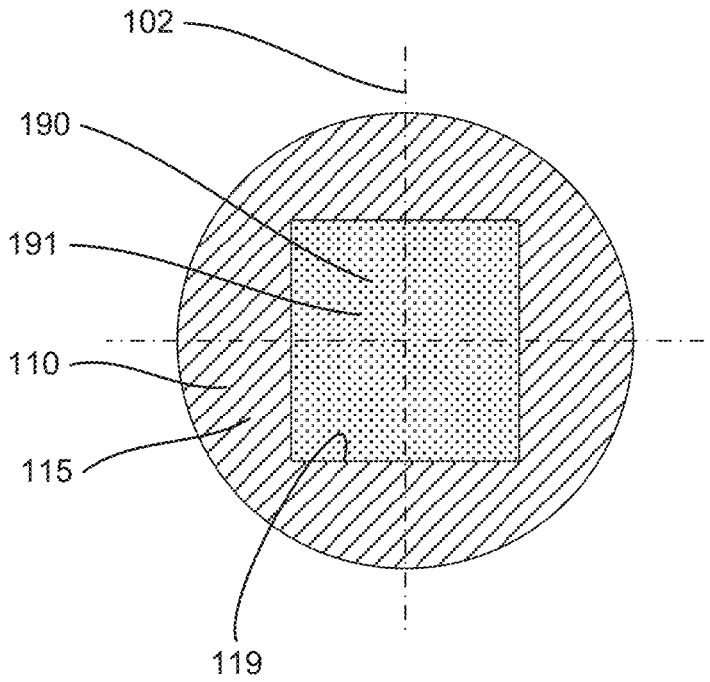
Figure 2D:
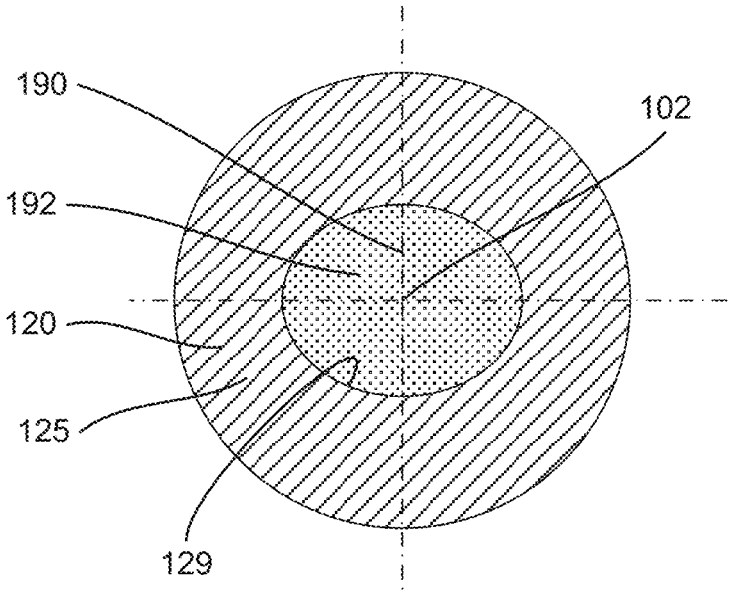
Figure 2E:
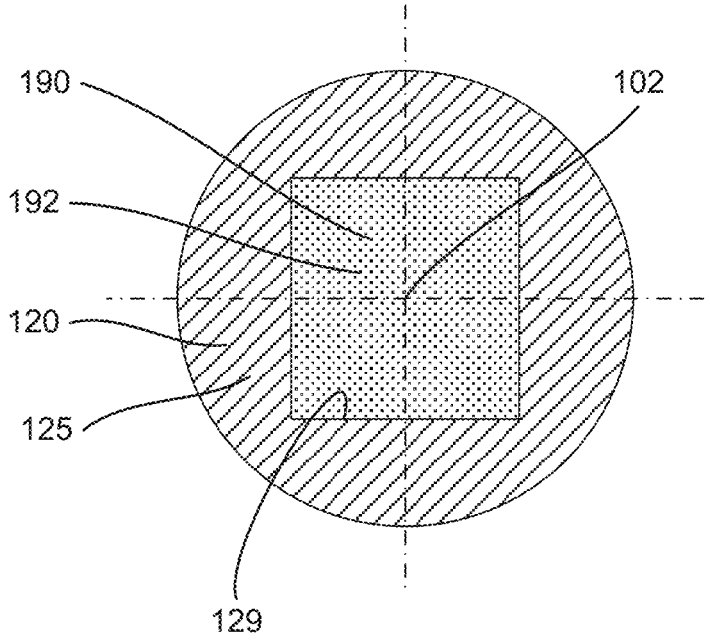
Figure 3A:
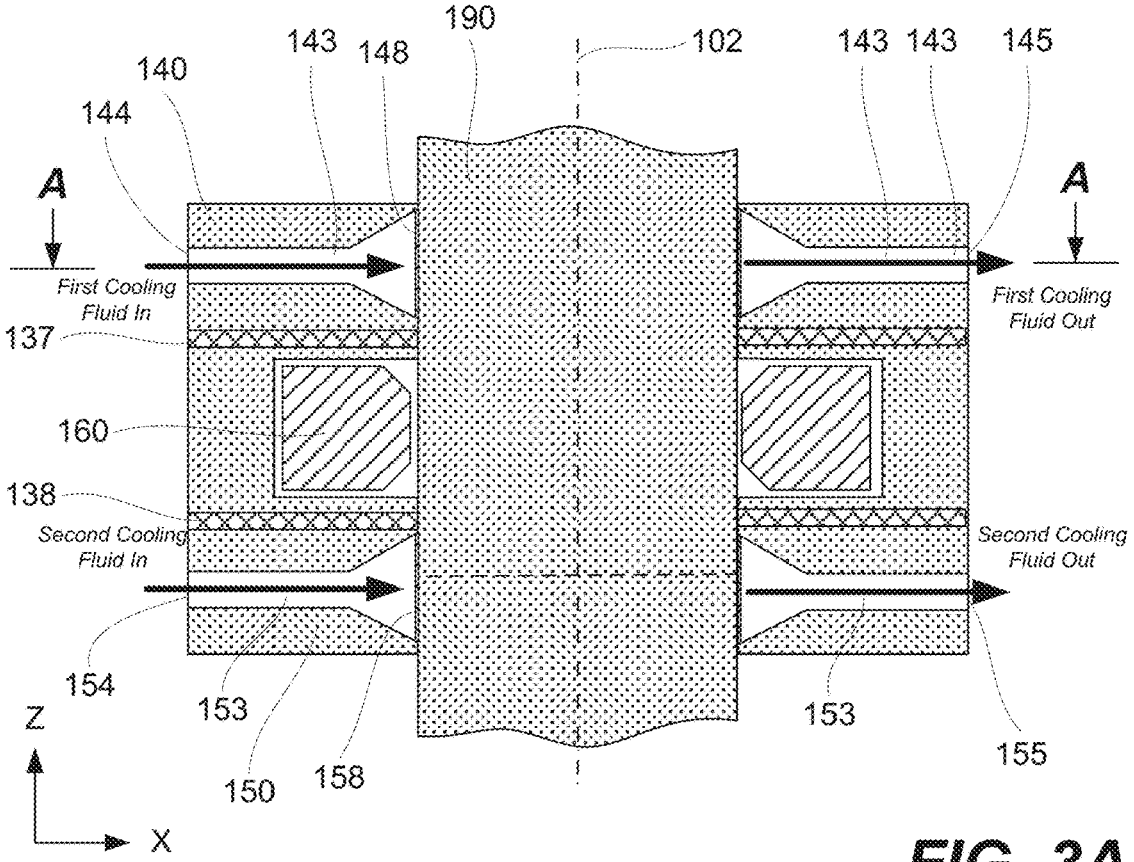
Figure 3B:
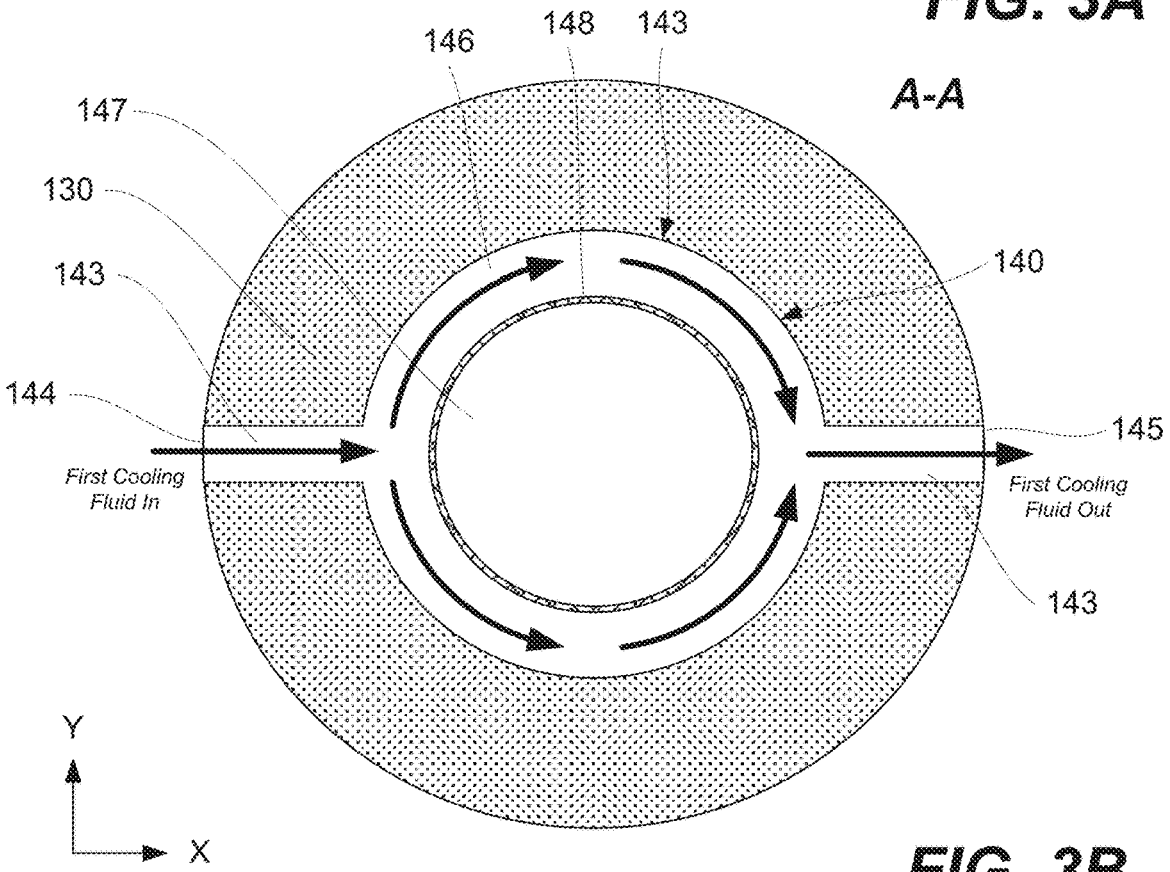
Figure 3C:
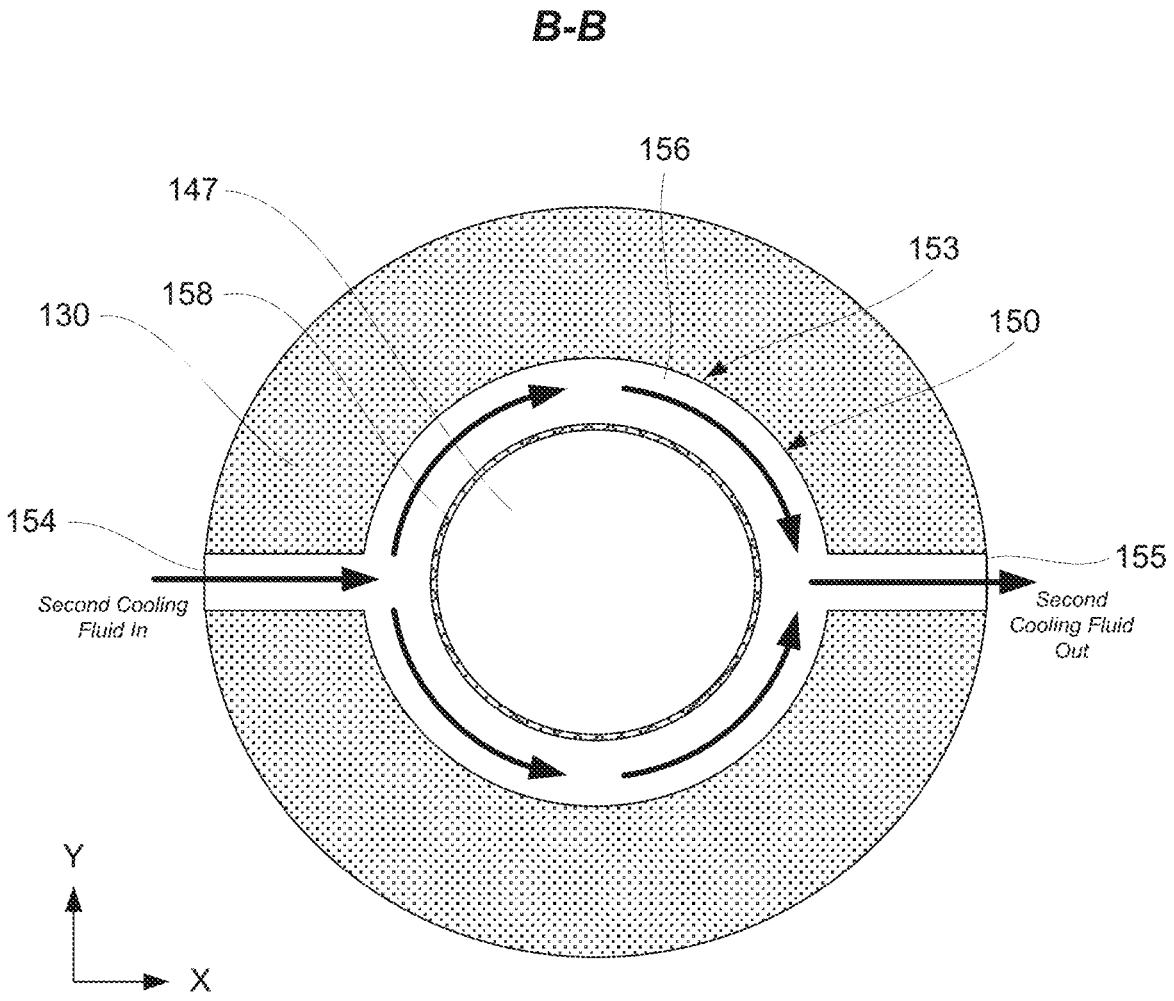
Figure 4A:
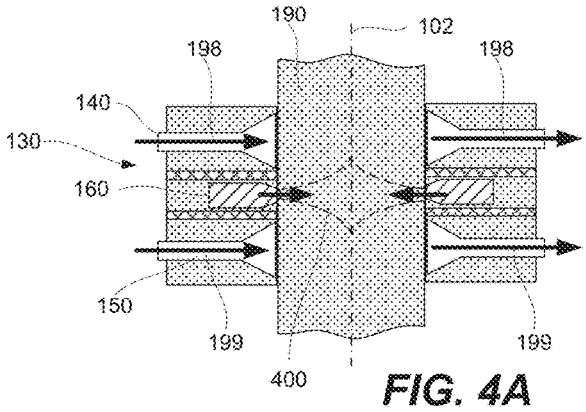
Figure 4B:
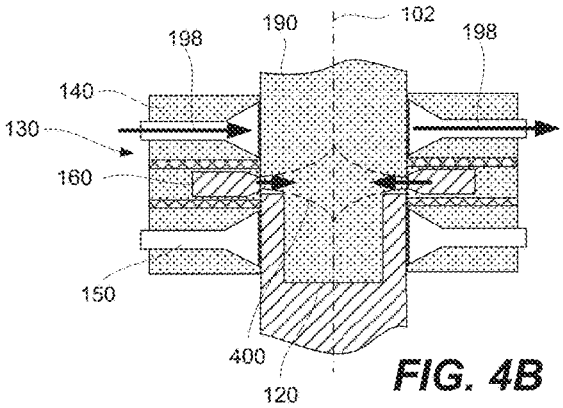
Figure 4C:
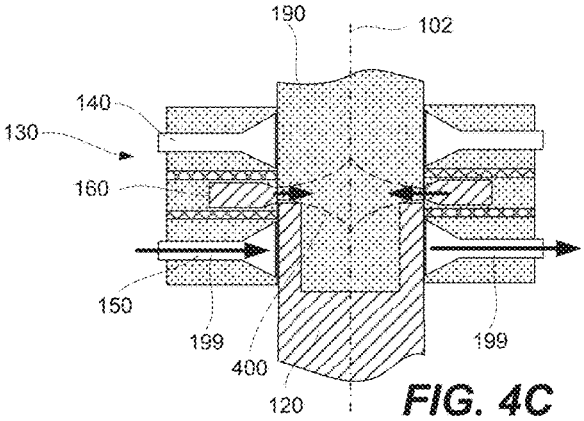
Figure 5:
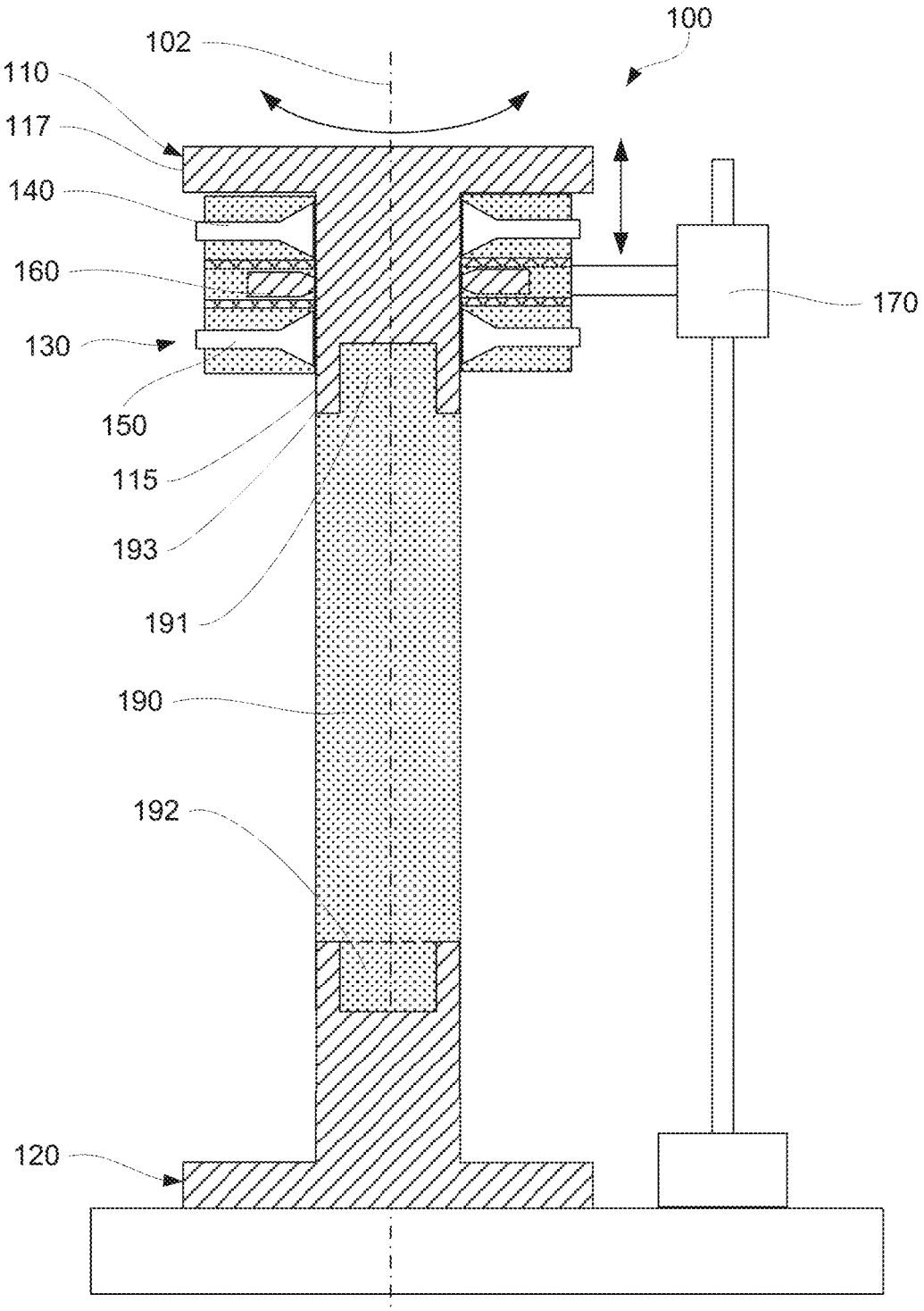
Figure 6:
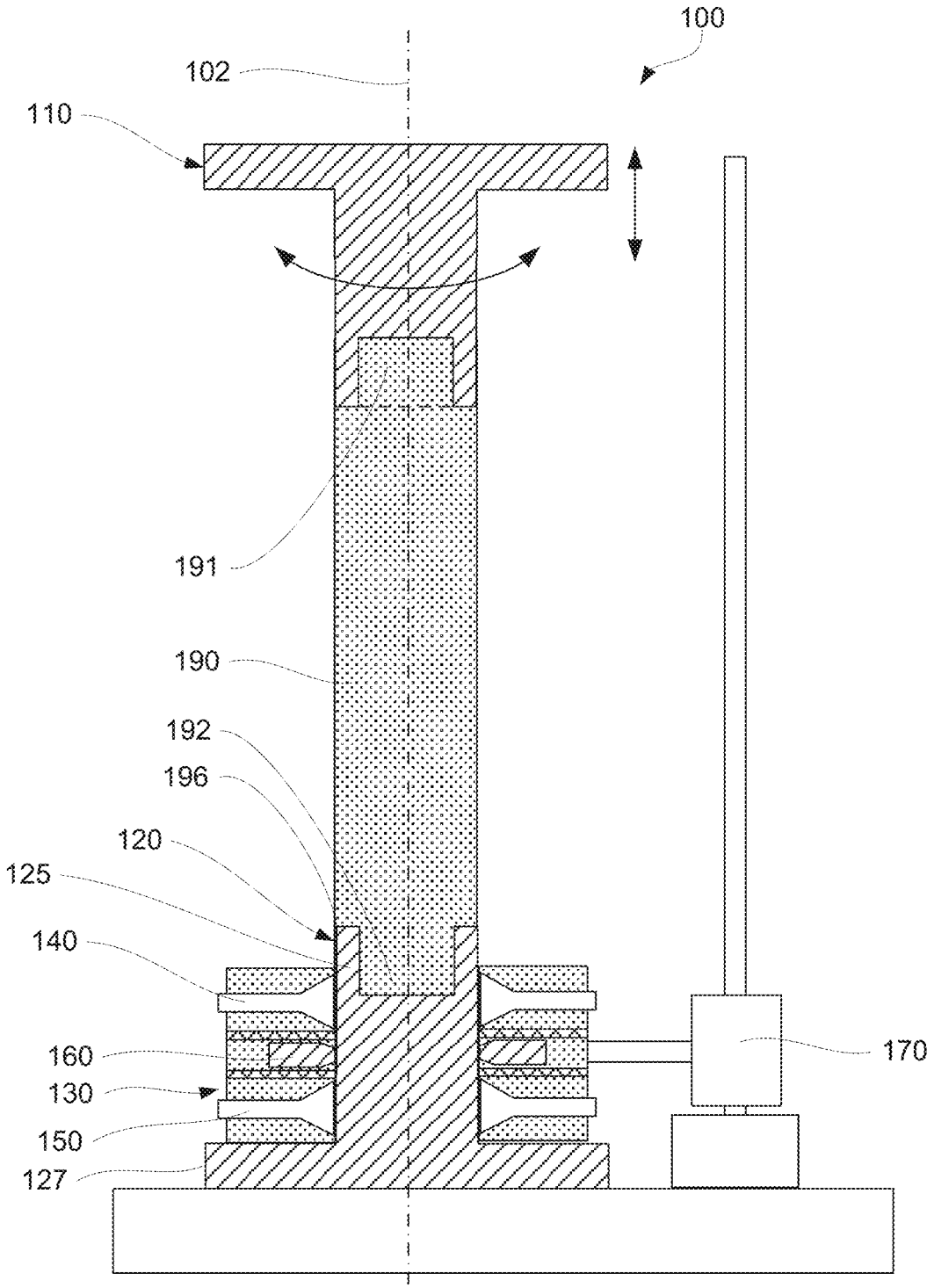
Figure 7A:
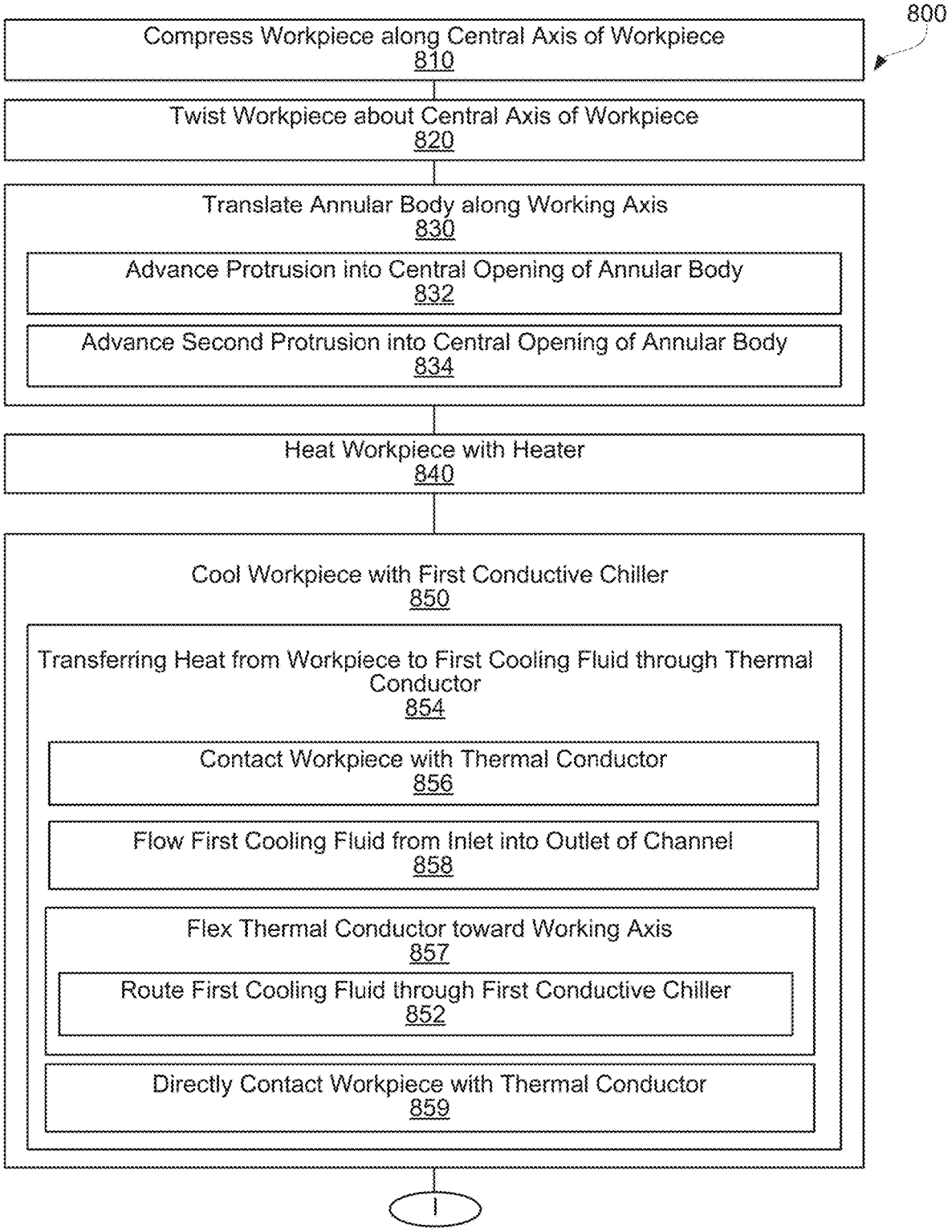
Figure 7B:
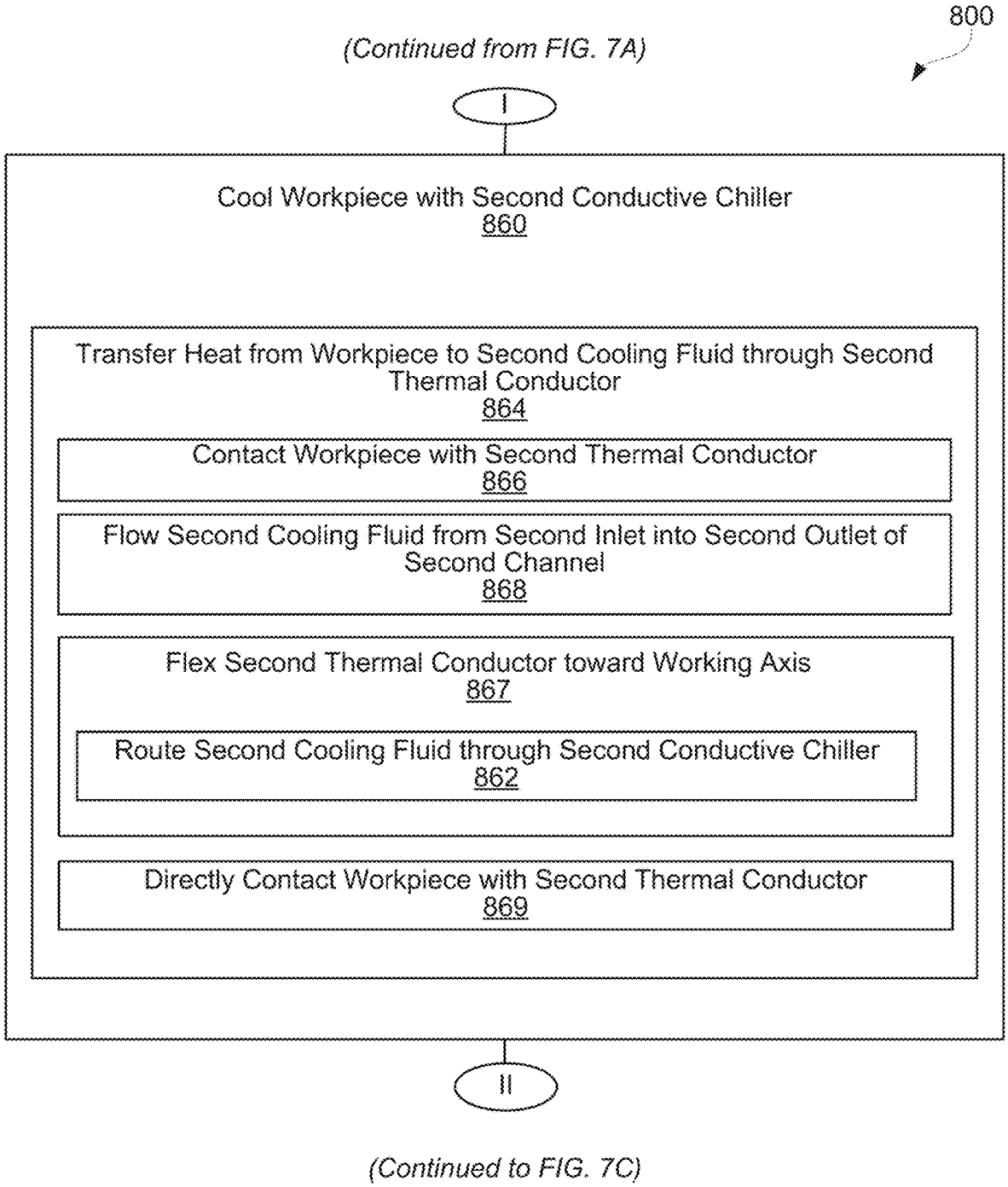
Figure 7C:
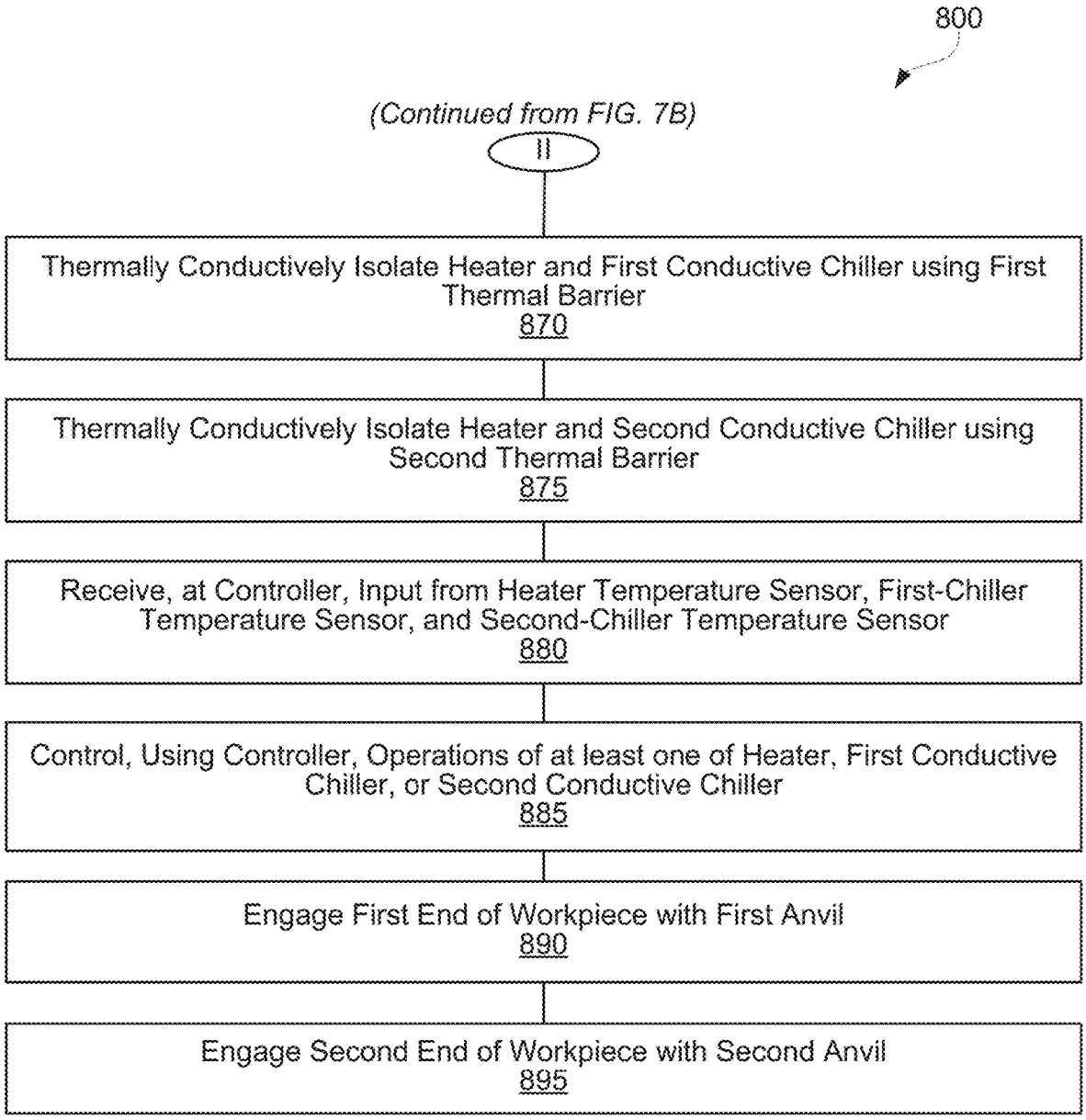
Figure 8:
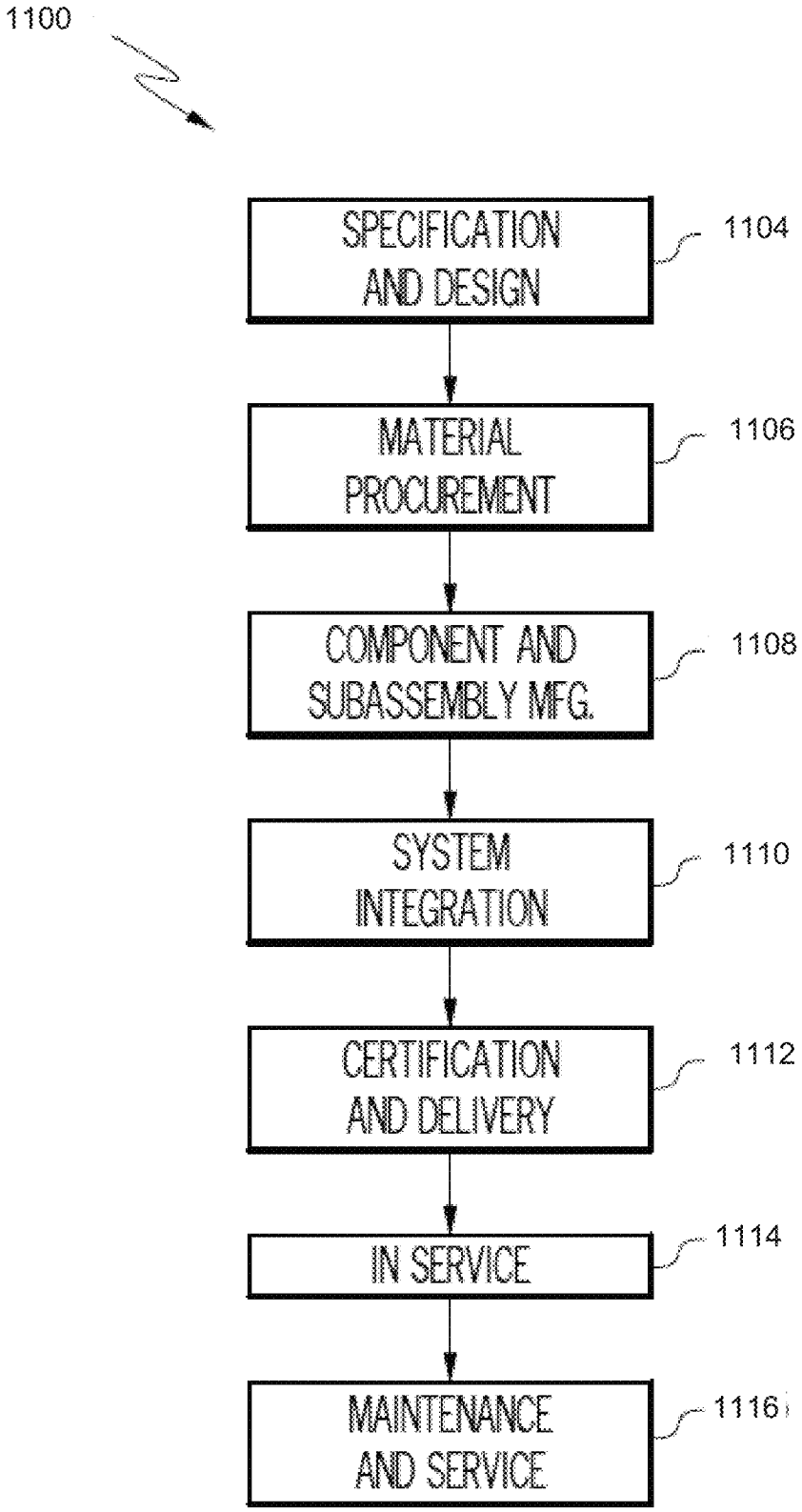
Figure 9:
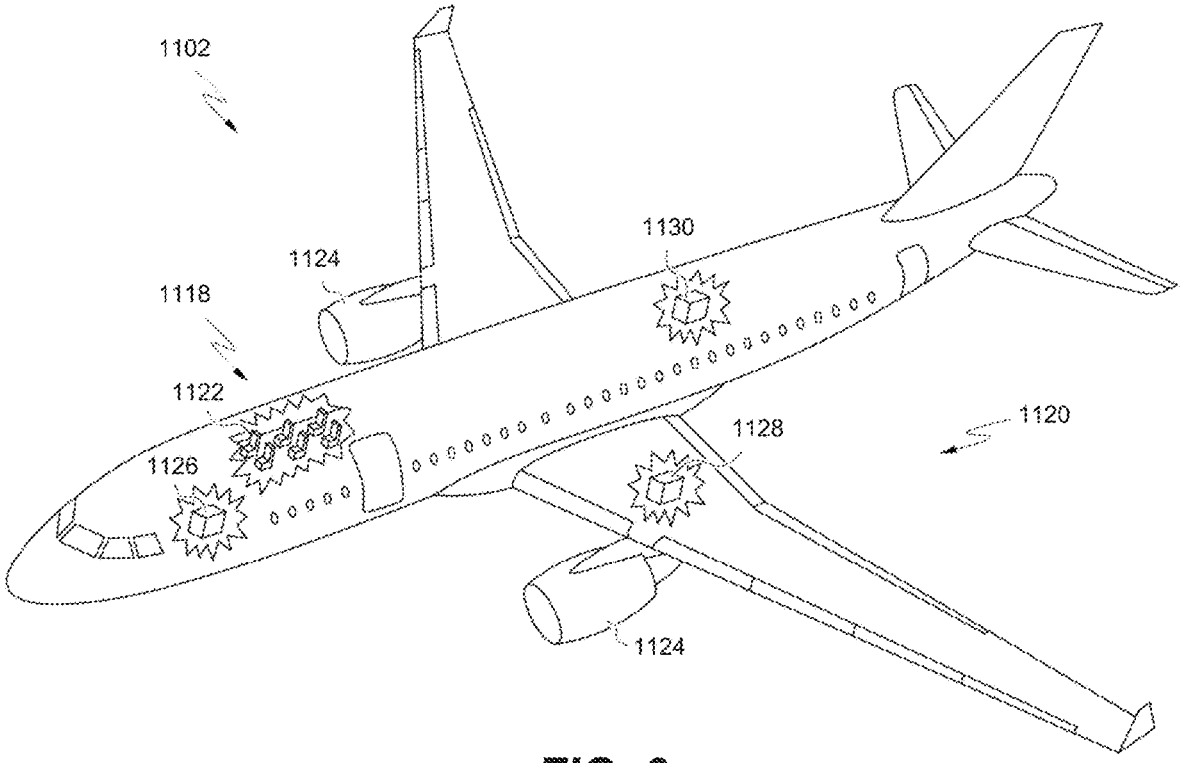

Having thus described one or more examples of the present disclosure in general terms, reference will now be made to the accompanying drawings, which are not necessarily drawn to scale, and wherein like reference characters designate the same or similar parts throughout the several views, and wherein:

FIGS. 1A and 1B, collectively, are a block diagram of an high-pressure-torsion apparatus, according to one or more examples of the present disclosure;

FIG. 2A is a schematic view of the high-pressure-torsion apparatus of FIGS. 1A and 1B, shown with a workpiece, according to one or more examples of the present disclosure;

FIGS. 2B and 2C are schematic, cross-sectional, top views of a first anvil of the high-pressure-torsion apparatus of FIGS. 1A and 1B, shown with a first end of the workpiece engaged by the first anvil, according to one or more examples of the present disclosure;

FIGS. 2D and 2E are schematic, cross-sectional, top views of a second anvil of the high-pressure-torsion apparatus of FIGS. 1A and 1B, shown with a second end of the workpiece engaged by the second anvil, according to one or more examples of the present disclosure;

FIG. 3A is a schematic, cross-sectional, side view of an annular body of the high-pressure-torsion apparatus of FIGS. 1A and 1B, shown with the workpiece protruding through a central opening in the annular body, according to one or more examples of the present disclosure;

FIG. 3B is a schematic, cross-sectional, top view of a first conductive chiller of the high-pressure-torsion apparatus of FIGS. 1A and 1B, without showing the workpiece, according to one or more examples of the present disclosure;

FIG. 3C is a schematic, cross-sectional, top view of a second conductive chiller of the high-pressure-torsion apparatus of FIGS. 1A and 1B, without showing the workpiece, according to one or more examples of the present disclosure;

FIGS. 4A-4C are schematic, cross-sectional, side views of the annular body of the high-pressure-torsion apparatus of FIGS. 1A and 1B, showing different operating modes of a first conductive chiller and a second conductive chiller, according to one or more examples of the present disclosure;

FIG. 5 is a schematic, cross-sectional, side view of the high-pressure-torsion apparatus of FIGS. 1A and 1B, showing a protrusion protruding through the central opening in the annular body, according to one or more examples of the present disclosure;

FIG. 6 is a schematic, cross-sectional, side view of the high-pressure-torsion apparatus of FIGS. 1A and 1B, showing a second protrusion protruding through the central opening in the annular body, according to one or more examples of the present disclosure;

FIGS. 7A-7C, collectively, are a block diagram of a method of modifying material properties of a workpiece, using the high-pressure-torsion apparatus of FIGS. 1A and 1B, according to one or more examples of the present disclosure;

FIG. 8 is a block diagram of aircraft production and service methodology; and FIG. 9 is a schematic illustration of an aircraft.

DETAILED DESCRIPTION

In FIGS. 1A and 1B, referred to above, solid lines, if any, connecting various elements and/or components may represent mechanical, electrical, fluid, optical, electromagnetic and other couplings and/or combinations thereof. As used herein, "coupled" means associated directly as well as indirectly. For example, a member A may be directly associated with a member B, or may be indirectly associated therewith, e.g., via another member C. It will be understood that not all relationships among the various disclosed elements are necessarily represented. Accordingly, couplings other than those depicted in the block diagrams may also exist. Dashed lines, if any, connecting blocks designating the various elements and/or components represent couplings similar in function and purpose to those represented by solid lines; however, couplings represented by the dashed lines may either be selectively provided or may relate to alternative examples of the present disclosure. Likewise, elements and/or components, if any, represented with dashed lines, indicate alternative examples of the present disclosure. One or more elements shown in solid and/or dashed lines may be omitted from a particular example without departing from the scope of the present disclosure. Environmental elements, if any, are represented with dotted lines. Virtual (imaginary) elements may also be shown for clarity. Those skilled in the art will appreciate that some of the features illustrated in FIGS. 1A and 1B may be combined in various ways without the need to include other features described in FIGS. 1A and 1B, other drawing figures, and/or the accompanying disclosure, even though such combination or combinations are not explicitly illustrated herein. Similarly, additional features not limited to the examples presented, may be combined with some or all of the features shown and described herein.

In FIG. 8, referred to above, the blocks may represent operations and/or portions thereof and lines connecting the various blocks do not imply any particular order or dependency of the operations or portions thereof. Blocks represented by dashed lines indicate alternative operations and/or portions thereof. Dashed lines, if any, connecting the various blocks represent alternative dependencies of the operations or portions thereof. It will be understood that not all dependencies among the various disclosed operations are necessarily represented. FIGS. 7A-7C and the accompanying disclosure describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, those skilled in the art will appreciate that not all operations described need be performed.

In the following description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one example" means that one or more feature, structure, or characteristic described in connection with the example is included in at least one implementation. The phrase "one example" in various places in the specification may or may not be referring to the same example.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

Illustrative, non-exhaustive examples, which may or may not be claimed, of the subject matter according the present disclosure are provided below.

Referring generally to FIGS. 1A and 1B and particularly to, e.g., FIGS. 2A, 4A-4C, 5, and 6, high-pressure-torsion apparatus 100 is disclosed. High-pressure-torsion apparatus 100 comprises working axis 102, first anvil 110, second anvil 120, and annular body 130. Second anvil 120 faces first anvil 110 and is spaced apart from first anvil 110 along working axis 102. First anvil 110 and second anvil 120 are translatable relative to each other along working axis 102. First anvil 110 and second anvil 120 are rotatable relative to each other about working axis 102. Annular body 130 comprises first conductive chiller 140, second conductive chiller, and heater 160. First conductive chiller 140 is translatable between first anvil 110 and second anvil 120 along working axis 102. First conductive chiller 140 is configured to be thermally conductively coupled with workpiece 190 that has surface 194 and central axis 195, collinear with working axis 102. First conductive chiller 140 is configured to selectively cool workpiece 190. Second conductive chiller 150 is translatable between first anvil 110 and second anvil 120 along working axis 102. Second conductive chiller 150 is configured to be thermally conductively coupled with workpiece 190. Second conductive chiller 150 is configured to selectively cool workpiece 190. Heater 160 is positioned between first conductive chiller 140 and second conductive chiller 150 along working axis 102. Heater 160 is translatable between first anvil 110 and second anvil 120 along working axis 102 and is configured to selectively heat workpiece 190. The preceding subject matter of this paragraph characterizes example 1 of the present disclosure.

High-pressure-torsion apparatus 100 is configured to process workpiece 190 by heating a portion of workpiece 190 while applying compression and torque to workpiece 190 to this heated portion. By heating only the portion of workpiece 190, rather than heating and processing workpiece 190 in its entirety at the same time, all of high-pressure-torsion deformation is confined to the narrow heated layer only, imparting high strains needed for fine-grain development. This reduction in compression and torque translates into a design of high-pressure-torsion apparatus 100 that is less complex and costly. Furthermore, this reduction in compression and torque results in more precise control over processing parameters, such as temperature, compression load, torque, processing duration, and the like. As such, more specific and controlled material microstructures of workpiece 190. For example, ultrafine grained materials offer substantial advantage over coarser grained materials displaying higher strength and better ductility. Finally, high-pressure-torsion apparatus 100 is able to process workpiece 190 having much large dimensions, e.g., a length, extending along working axis 102 of high-pressure-torsion apparatus 100, than would otherwise be possible if workpiece 190 is processed in its entirety at the same time.

A stacked arrangement of first conductive chiller 140, heater 160, and second conductive chiller 150 allows controlling size and position of each processed portion of workpiece 190. A processed portion generally corresponds to a heated portion, defined, at least in part, by the position of heater 160 relative to workpiece 190 and the heating output of heater 160. While compression and torque are applied to workpiece 190 in its entirety, the modification of material properties primarily happens in the heated portion. More specifically, the modification happens in a processed portion, which has a temperature within a desired processing range, which is defined as operating temperature zone 400. Various examples of operating temperature zone 400 are shown in FIGS. 4A-4C.

When first conductive chiller 140 and/or second conductive chiller 150 are operational, the heated portion of workpiece 190 is adjacent to a first cooled portion and/or a second cooled portion. The first cooled portion is defined, at least in part, by the position of first conductive chiller 140 relative to workpiece 190 and the cooling output of first conductive chiller 140. The second cooled portion is defined, at least in part, by the position of second conductive chiller 150 relative to workpiece 190 and the cooling output of second conductive chiller 150. The first cooled portion and/or the second cooled portion are used to control the internal heat transfer within workpiece 190, thereby controlling some characteristics of the processed portion and the shape of operating temperature zone 400, shown in FIGS. 4A-4C.

First conductive chiller 140, heater 160, and second conductive chiller 150 are translatable along working axis 102 to process different portions of workpiece 190, along central axis 195 of workpiece 190 defining the length of workpiece 190. As a result, high-pressure-torsion apparatus 100 is configured to process workpiece 190 with a large length relative to conventional pressure-torsion techniques, e.g., when workpiece 190 is processed in its entirety.

First anvil 110 and second anvil 120 are designed to engage and retain workpiece 190 at respective ends, e.g., first end 191 and second end 192. When workpiece 190 is engaged by first anvil 110 and second anvil 120, first anvil 110 and second anvil 120 are also used to apply compression force and torque to workpiece 190. One or both first anvil 110 and second anvil 120 are movable. In general, first anvil 110 and second anvil 120 are movable along working axis 102 relative to each other to apply the compression force and to engage workpieces, having different lengths. First anvil 110 and second anvil 120 are also rotatable about working axis 102 relative to each other. In one or more examples, at least one of first anvil 110 and second anvil 120 is coupled to drive 104 as, for example, schematically shown in FIG. 2A.

Annular body 130 integrates first conductive chiller 140, second conductive chiller 150, and heater 160. More specifically, annular body 130 supports and maintains the orientation of first conductive chiller 140, second conductive chiller 150, and heater 160 relative to each other. Annular body 130 also controls the position of first conductive chiller 140, second conductive chiller 150, and heater 160 relative to workpiece 190, e.g., when first conductive chiller 140, second conductive chiller 150, and heater 160 are translated relative to workpiece 190 along working axis 102.

In one or more examples, during operation of high-pressure-torsion apparatus 100, each of first conductive chiller 140 and second conductive chiller 150 is thermally conductively coupled with workpiece 190 and selectively cool respective portions of workpiece 190, e.g., a first cooled portion and a second cooled portion. These first and second cooled portions are positioned on opposite sides, along working axis 102, of a portion, heated by heater 160, which is referred to as a heated portion. A combination of these cooled and heated portions define the shape of operating temperature zone 400, which is being processed.

In one or more examples, the thermal conductive coupling between first conductive chiller 140 and workpiece 190 is provided by first cooling fluid 198. First cooling fluid 198 is flown through first conductive chiller 140 and discharged from first conductive chiller 140 toward workpiece 190. When first cooling fluid 198 contacts workpiece 190, the temperature of first cooling fluid 198 is less than that of workpiece 190, at least at this contact location, resulting in cooling of the corresponding portion of workpiece 190. After contacting workpiece 190, first cooling fluid 198 is discharged into the environment.

Similarly, in one or more examples, the thermal conductive coupling between second conductive chiller 150 and workpiece 190 is provided by second cooling fluid 199. Second cooling fluid 199 is flown through second conductive chiller 150 and discharged from second conductive chiller 150 toward workpiece 190. When second cooling fluid 199 contacts workpiece 190, the temperature of second cooling fluid 199 is less than that of workpiece 190, at least at this location, resulting in cooling of the corresponding portion of workpiece 190. After contacting workpiece 190, second cooling fluid 199 is discharged into the environment.

Heater 160 is configured to selectively heat workpiece 190 either through direct contact with workpiece 190 or radiation. In case of radiation heating, heater 160 is spaced away from workpiece 190, resulting in a gap between heater 160 and workpiece 190. Various heater types, such as a resistive heater, an induction heater, and the like, are within the scope of the present disclosure. In one or more examples, heating output of heater 160 is controllably adjustable. As noted above, heating output determines the shape of operating temperature zone 400.

Referring generally to FIGS. 1A and 1B and particularly to, e.g., FIGS. 2A, 4A, 5, and 6, heater 160, first conductive chiller 140, and second conductive chiller 150 are translatable as unit between first anvil 110 and second anvil 120 along working axis 102. The preceding subject matter of this paragraph characterizes example 2 of the present disclosure, wherein example 2 also includes the subject matter according to example 1, above.

When heater 160, first conductive chiller 140, and second conductive chiller 150 are translatable as a unit, the orientation of first conductive chiller 140, heater 160, and second conductive chiller 150, relative to each other, is maintained. Specifically, the distance between heater 160 and first conductive chiller 140 remains the same. Likewise, the distance between heater 160 and second conductive chiller 150 remains the same. These distances determine the shape of operating temperature zone 400 within workpiece 190 as is schematically shown, for example, in FIG. 4A. Therefore, when these distances are kept constant, the shape of operating temperature zone 400 also remains the same, which ensures processing consistency.

In one or more examples, annular body 130 is operable as a housing and/or structural support for heater 160, first conductive chiller 140, and second conductive chiller 150. Annular body 130 establishes a translatable unit, comprising heater 160, first conductive chiller 140, and second conductive chiller 150. In one or more examples, annular body 130 is connected to linear actuator 170, which translates annular body 130 and as, a result, also translates heater 160, first conductive chiller 140, and second conductive chiller 150 together along working axis 102.

Referring generally to FIGS. 1A and 1B and particularly to, e.g., FIGS. 4A-4C, heater 160 is configured to heat workpiece 190 when at least one of first conductive chiller 140 or second conductive chiller 150 is cooling workpiece 190. The preceding subject matter of this paragraph characterizes example 3 of the present disclosure, wherein example 3 also includes the subject matter according to example 1 or 2, above.

The shape of operating temperature zone 400, schematically shown in FIGS. 4A-4C, is controlled by heating action of heater 160 and cooling actions of first conductive chiller 140 and second conductive chiller 150. When heater 160 heats a portion of workpiece 190, heat spreads out from this portion, e.g., along central axis 195 of workpiece 190, due to the thermal conductivity of the material, forming workpiece 190. This internal heat transfer impacts the shape of operating temperature zone 400. To reduce or at least to control the effect of this internal heat transfer within workpiece 190, at least one of first conductive chiller 140 or second conductive chiller 150 is used for cooling one or more portions of workpiece 190, adjacent to the heated portion of workpiece 190.

In one or more examples, both first conductive chiller 140 and second conductive chiller 150 are used for selective cooling portions of workpiece 190 while heater 160 selectively heats a portion of workpiece 190. For example, at a certain processing stage, annular body 130 is positioned away from either first anvil 110 or second anvil 120, as schematically shown in FIG. 2A. At this stage, neither first anvil 110 nor second anvil 120 has a significant impact as a heat sink on the heated portion of workpiece 190. To control the internal heat transfer within workpiece 190 away from the heated portion in both directions along central axis 195, first conductive chiller 140 and second conductive chiller 150 are both used at the same time, as, for example, schematically shown in FIG. 4A. It should be noted that, in one or more examples, the cooling output of first conductive chiller 140 is different from that of second conductive chiller 150. In specific examples, when annular body 130 is translated from first anvil 110 to second anvil 120 and second conductive chiller 150 is closer to second anvil 120 than first conductive chiller 140, the cooling level of second conductive chiller 150 is less than the cooling level of first conductive chiller 140. In this example, second conductive chiller 150 moves before heater 160 while first conductive chiller 140 follows heater 160. As such, the portion of workpiece 190 facing second conductive chiller 150 requires less cooling than the portion of workpiece 190 facing first conductive chiller 140 to be at the same temperature.

Alternatively, in one or more examples, only one of first conductive chiller 140 or second conductive chiller 150 is used for cooling workpiece 190 while heater 160 heats workpiece 190. The other one of first conductive chiller 140 or second conductive chiller 150 is turned off and does not provide any cooling output. These examples are used when annular body 130 approaches or slides over first anvil 110 or second anvil 120. At these processing stages, first anvil 110 or second anvil 120 acts as a heat sink and cools workpiece 190. In other words, first anvil 110 or second anvil 120 already reduces the effect of the internal heat conduction within workpiece 190 and additional cooling from either first conductive chiller 140 or second conductive chiller 150 is not needed.

Referring generally to FIGS. 1A and 1B and particularly to, e.g., FIGS. 4B and 4C, heater 160 is configured to heat workpiece 190 when at least one of first conductive chiller 140 or second conductive chiller 150 is not cooling workpiece 190. The preceding subject matter of this paragraph characterizes example 4 of the present disclosure, wherein example 4 also includes the subject matter according to example 1 or 2, above.

The shape of operating temperature zone 400, schematically shown in FIG. 4A-4C, is controlled, at least in part, by heating action of heater 160 and cooling actions of first conductive chiller 140 and second conductive chiller 150. The shape is also affected by internal heat transfer within workpiece 190 (e.g., from a heated portion) and, in one or more examples, external heat transfer, such as between workpiece 190 and other components, engaging workpiece 190 (e.g., first anvil 110 and second anvil 120). To compensate for effects of external heat transfer, in one or more examples, first conductive chiller 140 and/or second conductive chiller 150 is turned off and does not cool workpiece 190.

Referring to a processing stage, shown in FIG. 4B, heater 160 heats a portion of workpiece 190, positioned near or even engaged by second anvil 120. At this stage, second anvil 120 operates as a heat sink, resulting in external heat transfer from workpiece 190 to second anvil 120. In this example, second conductive chiller 150, which is positioned closer to second anvil 120 than heater 160 or which is already positioned around second anvil 120 as shown in FIG. 4B, is turned off and not cooling workpiece 190. Alternatively, referring to FIG. 4C, second conductive chiller 150, which is still positioned closer to second anvil 120 than heater 160 or which is already positioned around second anvil 120, is turned on and now cooling second anvil 120. This feature is used to prevent damage to second anvil 120.

Operation of first conductive chiller 140 and second conductive chiller 150 is individually controllable. In one example, both first conductive chiller 140 and second conductive chiller 150 are operational and cooling respective portions of workpiece 190. In another example, one of first conductive chiller 140 and second conductive chiller 150 is operational while the other one of first conductive chiller 140 and second conductive chiller 150 is not operational. For example, first conductive chiller 140 is not operational while second conductive chiller 150 is operational, e.g., when annular body 130 approaches first anvil 110 and/or when first anvil 110 at least partially protrudes through annular body 130. Alternatively, first conductive chiller 140 is operational while second conductive chiller 150 is not operational, e.g., when annular body 130 approaches second anvil 120 and/or when second anvil 120 at least partially protrudes through annular body 130. Furthermore, in one or more examples, both first conductive chiller 140 and second conductive chiller 150 are not operational while heater 160 is operational. In one or more examples, the operation of each of first conductive chiller 140 and second conductive chiller 150 is controlled based on position of annular body 130 (e.g., relative to first anvil 110 or second anvil 120) and/or temperature feedback, as further described below. Furthermore, levels of cooling output of first conductive chiller 140 and second conductive chiller 150 are individually controllable.

Referring generally to FIGS. 1A and 1B and particularly to, e.g., FIG. 3A, high-pressure-torsion apparatus 100 further comprises first thermal barrier 137, thermally conductively isolating heater 160 and first conductive chiller 140 from each other and configured to be in contact with workpiece 190. High-pressure-torsion apparatus 100 further comprises second thermal barrier 138, thermally conductively isolating heater 160 and second conductive chiller 150 from each other and configured to be in contact with workpiece 190. The preceding subject matter of this paragraph characterizes example 5 of the present disclosure, wherein example 5 also includes the subject matter according to any one of examples 1 to 4, above.

First thermal barrier 137 reduces heat transfer between heater 160 and first conductive chiller 140 thereby improving heating efficiency of heater 160 and cooling efficiency of first conductive chiller 140. Furthermore, when first thermal barrier 137 extends to and contacts workpiece 190 as, for example, is shown in FIG. 3E, first thermal barrier 137 also prevents flow of first cooling fluid 198 into the space between heater 160 and workpiece 190. In other words, first thermal barrier 137 is also operable as a seal. Similarly, second thermal barrier 138 reduces heat transfer between heater 160 and second conductive chiller 150 thereby improving heating efficiency of heater 160 and cooling efficiency of second conductive chiller 150. When second thermal barrier 138 extends to and contacts workpiece 190 as, for example, is shown in FIG. 3E, second thermal barrier 138 also prevents flow of second cooling fluid 199 into the space between heater 160 and workpiece 190. In other words, second thermal barrier 138 is also operable as a seal.

In one or more examples, first thermal barrier 137 and/or second thermal barrier 138 are formed from a heat-insulating material, e.g., a material with a thermal conductivity of less than of less than 1 W/m*K. Some examples of suitable material are fiberglass, mineral wool, cellulose, polymer foams (e.g., polyurethane foam, polystyrene foam). In one or more examples, the thickness of first thermal barrier 137 and/or second thermal barrier 138 is small, e.g., less than 10 millimeters or even less than 5 millimeters to ensure that the distance between heater 160 and first conductive chiller 140 as well as the distance between heater 160 and second conductive chiller 150 are small. The proximity of first conductive chiller 140 and second conductive chiller 150 to heater 160 ensures that the height (axial dimension) of operating temperature zone 400 is small.

In one or more examples, the inner diameter of first thermal barrier 137 and second thermal barrier 138 is less than the diameter of workpiece 190 to ensure the interference fit and sealing between first thermal barrier 137 and workpiece 190 and, separately, between second thermal barrier 138 and workpiece 190. When first thermal barrier 137 extends to and contacts workpiece 190, no separate seal is needed between annular body 130 and workpiece 190, at least in around first conductive chiller 140. Similarly, when second thermal barrier 138 extends to and contacts workpiece 190, no separate seal is needed between annular body 130 and workpiece 190, at least in around second conductive chiller 150.

Referring generally to FIGS. 1A and 1B and particularly to, e.g., FIGS. 3B and 3C, annular body 130 has central opening 147, sized to receive workpiece 190. The preceding subject matter of this paragraph characterizes example 6 of the present disclosure, wherein example 6 also includes the subject matter according to any one of examples 1 to 5, above.

Central opening 147 allows workpiece 190 to protrude through annular body 130 such that annular body 130 surrounds workpiece 190. As such, various components of annular body 130 have access to the entire perimeter of workpiece 190 and able to process the entire perimeter. Specifically, first conductive chiller 140 is operable to selectively cool a portion of workpiece 190 around the entire perimeter of workpiece 190. Likewise, heater 160 is operable to selectively heat another portion of workpiece 190 around the entire perimeter of workpiece 190. Finally, second conductive chiller 150 is operable to selective cool yet another portion of workpiece 190 around the entire perimeter of workpiece 190.

In one or more examples, annular body 130 and workpiece 190 have clearance fit to allow for annular body 130 to freely move relative to workpiece 190, especially when workpiece 190 radially expands during heating. More specifically, the gap between annular body 130 and workpiece 190, in the radial direction, is between 1 millimeter and 10 millimeters wide, around the entire perimeter or, more specifically, between 2 millimeters and 8 millimeters. In specific examples, the gap is uniform around the entire perimeter.

Referring generally to FIGS. 1A and 1B and particularly to, e.g., FIG. 5, first anvil 110 comprises base 117 and protrusion 115, extending from base 117 toward second anvil 120 along working axis 102. Protrusion 115 has a diameter that is smaller than that of base 117 and than that of central opening 147 of annular body 130. The preceding subject matter of this paragraph characterizes example 7 of the present disclosure, wherein example 7 also includes the subject matter according to example 6, above.

When the diameter of protrusion 115 is smaller than the diameter of central opening 147 of annular body 130, protrusion 115 is able to protrude into central opening 147 as, for example, schematically shown in FIG. 5. This feature allows maximizing the processed length of workpiece 190. Specifically, in one or more examples, the entire portion of workpiece 190, extending between first anvil 110 and second anvil 120, is accessible to each processing component of annular body 130, such as first conductive chiller 140, heater 160, and second conductive chiller 150.

In one or more examples, the diameter of protrusion 115 is the same as the diameter of the portion of workpiece 190, extending between first anvil 110 and second anvil 120 and not engaged by first anvil 110 and second anvil 120. This ensures continuity of the seal when first conductive chiller 140 faces protrusion 115, e.g., past external interface point 193 between protrusion 115 and workpiece 190.

Referring generally to FIGS. 1A and 1B and particularly to, e.g., FIG. 5, protrusion 115 of first anvil 110 has a maximum dimension along working axis 102 that is equal to or greater than that of annular body 130. The preceding subject matter of this paragraph characterizes example 8 of the present disclosure, wherein example 8 also includes the subject matter according to example 7, above.

When the maximum dimension of protrusion 115 along working axis 102 is equal to or greater than that of annular body 130, protrusion 115 is able to protrude through annular body 130 entirely. As such, all three operating components of annular body 130 pass external interface point 193 between protrusion 115 and workpiece 190 as, for example, shown in FIG. 5. As such, the portion of workpiece 190, extending between first anvil 110 and second anvil 120, is accessible to each processing component of annular body 130. In one or more examples, the maximum dimension of protrusion 115 along working axis 102 is greater than that of annular body 130 by between about 5% and 50% or, more specifically, by between about 100 and 30%.

Referring generally to FIGS. 1A and 1B and particularly to, e.g., FIG. 5, protrusion 115 of first anvil 110 has a maximum dimension along working axis 102 that is at least one half of that of annular body 130. The preceding subject matter of this paragraph characterizes example 9 of the present disclosure, wherein example 9 also includes the subject matter according to example 7, above.

When the maximum dimension of protrusion 115 along working axis 102 that is at least one half of that of annular body 130, protrusion 115 protrudes through at least half of annular body 130 entirely. As such, external interface point 193 is reached and heated by at least heater 160 of annular body 130. In one or more examples, heater 160 is positioned in the middle of annular body 130 along working axis 102. In one or more examples, the maximum dimension of protrusion 115 along working axis 102 is greater than one half that of annular body 130 by between about 5% and 50% or, more specifically, by between about 10% and 30%.

Referring generally to FIGS. 1A and 1B and particularly to, e.g., FIG. 6, second anvil 120 comprises second base 127 and second protrusion 125, extending from second base 127 toward first anvil 110 along working axis 102. Second protrusion 125 of second anvil 120 has a diameter that is smaller than that of second base 127 and than that of central opening 147 of annular body 130. The preceding subject matter of this paragraph characterizes example 10 of the present disclosure, wherein example 10 also includes the subject matter according to any one of examples 7 to 9, above.

The diameter of second protrusion 125 being smaller than the diameter of central opening 147 of annular body 130 allows second protrusion 125 to protrude into central opening 147 as, for example, schematically shown in FIG. 6. This feature allows maximizing the processed length of workpiece 190. Specifically, in one or more examples, a portion of workpiece 190, extending between first anvil 110 and second anvil 120, is accessible to each processing component of annular body 130. In one or more examples, the diameter of second protrusion 125 is the same as the diameter of the portion of workpiece 190, extending between first anvil 110 and second anvil 120 and not engaged by first anvil 110 and second anvil 120. This ensures continuity of the seal when second conductive chiller 150 faces second protrusion 125, e.g., past external interface point 196 between protrusion 115 and workpiece 190.

Referring generally to FIGS. 1A and 1B and particularly to, e.g., FIG. 6, second protrusion 125 of second anvil 120 has a maximum dimension along working axis 102 that is equal to that of annular body 130. The preceding subject matter of this paragraph characterizes example 11 of the present disclosure, wherein example 11 also includes the subject matter according to example 10, above.

When the maximum dimension of second protrusion 125 along working axis 102 that is equal to or greater than that of annular body 130, second protrusion 125 protrudes through annular body 130 entirely. As such, all three operating components of annular body 130 pass external interface point 193 between second protrusion 125 and workpiece 190. As such, the portion of workpiece 190, extending between first anvil 110 and second anvil 120, is accessible to each processing component of annular body 130. In one or more examples, the maximum dimension of second protrusion 125 along working axis 102 is greater than that of annular body 130 by between about 5% and 50% or, more specifically, by between about 10% and 30%.

Referring generally to FIGS. 1A and 1B and particularly to, e.g., FIG. 6, second protrusion 125 of second anvil 120 has a maximum dimension along working axis 102 that is equal to or greater than one half of that of annular body 130. The preceding subject matter of this paragraph characterizes example 12 of the present disclosure, wherein example 12 also includes the subject matter according to example 10, above.

When the maximum dimension of second protrusion 125 along working axis 102 that is at least one half of that of annular body 130, second protrusion 125 protrudes through at least half of annular body 130 entirely. As such, external interface point 193 is reached and heated by at least heater 160 of annular body 130. In one or more examples, heater 160 is positioned in the middle of annular body 130 along working axis 102. In one or more examples, the maximum dimension of second protrusion 125 along working axis 102 is greater than one half that of annular body 130 by between about 5% and 50% or, more specifically, by between about 10° % and 30%.

Referring generally to FIGS. 1A and 1B and particularly to, e.g., FIGS. 3A and 3B, first conductive chiller 140 comprises channel 143, comprising inlet 144, outlet 145, and intermediate portion 146, which is in fluidic communication with inlet 144 and outlet 145. First conductive chiller 140 further comprises thermal conductor 148, fluidically isolating intermediate portion 146 of channel 143 from central opening 147 of annular body 130. The preceding subject matter of this paragraph characterizes example 13 of the present disclosure, wherein example 13 also includes the subject matter according to any one of examples 6 to 12, above.

Referring to FIGS. 3A and 3B, when first conductive chiller 140 is operational, first cooling fluid 198 is supplied into channel 143, through inlet 144. First cooling fluid 198 flows through channel 143 and exits through outlet 145. The temperature of first cooling fluid 198 is less than that of workpiece 190. First cooling fluid 198 contacts thermal conductor 148, which transfer heat from a portion of workpiece 190 to first cooling fluid 198, resulting in cooling of that portion. Thermal conductor 148 prevents direct contact between first cooling fluid 198 and workpiece 190 and also seals first cooling fluid 198 within channel 143.

Inlet 144 is configured to connect to a cooling-fluid source, such as a line or conduit, a compressed-gas cylinder, a pump, and the like. In one or more examples, the flow rate of first cooling fluid 198 is controlled.

Referring generally to FIGS. 1A and 1B and particularly to, e.g., FIG. 3B, intermediate portion 146 of channel 143 has a closed shape and surrounds working axis 102. The preceding subject matter of this paragraph characterizes example 14 of the present disclosure, wherein example 14 also includes the subject matter according to example 13, above.

Intermediate portion 146 surrounds workpiece 190 such that a portion of workpiece 190, facing first conductive chiller 140, is uniformly cooled around the perimeter of this portion. First cooling fluid 198 flows through intermediate portion 146, between inlet 144 and outlet 145.

Referring generally to FIGS. 1A and 1B and particularly to, e.g., FIGS. 3A and 3B, thermal conductor 148 of first conductive chiller 140 is sufficiently flexible in any direction, perpendicular to working axis 102, to directly contact workpiece 190 when intermediate portion 146 of channel 143 is pressurized with first cooling fluid 198. The preceding subject matter of this paragraph characterizes example 15 of the present disclosure, wherein example 15 also includes the subject matter according to example 13 or 14, above.

The flexibility of thermal conductor 148 ensures that thermal conductor 148 is able to ensure direct contact with workpiece 190 and efficient heat transfer through this direct contact. In one or more examples, before channel 143 is pressurized with first cooling fluid 198, thermal conductor 148 is positioned away from workpiece 190, e.g., having a clearance fit. The clearance fit allows workpiece 190 to protrude through first conductive chiller 140. Yet, when channel 143 is pressurized with first cooling fluid 198, thermal conductor 148 is forced against workpiece 190 thereby establishing direct contact and heat transfer. Even with direct contact between thermal conductor 148 and workpiece 190, annular body 130 or, more specifically, first conductive chiller 140 is able to move relative to workpiece 190.

Referring generally to FIGS. 1A and 1B and particularly to, e.g., FIGS. 3A and 3B, first cooling fluid 198 is a liquid. The preceding subject matter of this paragraph characterizes example 16 of the present disclosure, wherein example 16 also includes the subject matter according to example 15, above.

Liquids generally have higher heat capacities than gases, e.g., 4,186 $Jkg^{-1}K^{-1}$ for water vs. 993 $Jkg^{-1}K^{-1}$. Furthermore, liquids generally have higher densities than gases, e.g., 1000 kg/m$^3$ for water vs. 1.275 kg/m$^3$. As such, volumetric capacity (considering the space between first conductive chiller 140 and workpiece 190) is much greater for liquids than for gases, more than 3,000 times higher for water than for air. Overall, the same volume of cooling liquid, passing through channel 143, results in much higher cooling efficiencies than cooling gas, assuming the same temperature. One or more examples of the cooling liquid are water, mineral oil, and the like.

Referring generally to FIGS. 1A and 1B and particularly to, e.g., FIGS. 3A and 3C, second conductive chiller 150 comprises second channel 153, comprising second inlet 154, second outlet 155, and second intermediate portion 156, which is in fluidic communication with second inlet 154 and second outlet 155. Second conductive chiller 150 further comprises second thermal conductor 158, fluidically isolating second intermediate portion 156 of second channel 153 from central opening 147 of annular body 130. The preceding subject matter of this paragraph characterizes example 17 of the present disclosure, wherein example 17 also includes the subject matter according to example 16, above.

Referring to FIGS. 3A and 3C, when second conductive chiller 150 is operational, second cooling fluid 199 is supplied into second channel 153, through second inlet 154. Second cooling fluid 199 flows through second channel 153 and exits through second outlet 155. The temperature of second cooling fluid 199 is less than that of workpiece 190. Second cooling fluid 199 contacts second thermal conductor 158, which transfer heat from a portion of workpiece 190 to second cooling fluid 199, resulting in cooling of that portion. Second thermal conductor 158 prevents direct contact between second cooling fluid 199 and workpiece 190 and also seals second cooling fluid 199 within second channel 153.

Second inlet 154 is configured to connect to a cooling-fluid source, such as a line or conduit, a compressed-gas cylinder, a pump, and the like. In one or more examples, the flow rate of second cooling fluid 199 is controlled.

Referring generally to FIGS. 1A and 1B and particularly to, e.g., FIG. 3C, second intermediate portion 156 of second channel 153 has a closed shape and surrounds working axis 102. The preceding subject matter of this paragraph characterizes example 18 of the present disclosure, wherein example 18 also includes the subject matter according to example 17, above.

Second intermediate portion 156 surrounds workpiece 190 such that a portion of workpiece 190, facing second conductive chiller 150, is uniformly cooled around the perimeter of this portion. Second cooling fluid 199 flows through second intermediate portion 156, between second inlet 154 and second outlet 155.

Referring generally to FIGS. 1A and 1B and particularly to, e.g., FIG. 3A, second thermal conductor 158 of second conductive chiller 150 is sufficiently flexible in any direction, perpendicular to working axis 102, to directly contact workpiece 190 when second intermediate portion 156 of second channel 153 is pressurized with second cooling fluid 199. The preceding subject matter of this paragraph characterizes example 19 of the present disclosure, wherein example 19 also includes the subject matter according to example 18, above.

The flexibility of second thermal conductor 158 ensures that second thermal conductor 158 is able to ensure direct contact with workpiece 190 and efficient heat transfer through this direct contact. In one or more examples, before second channel 153 is pressurized with second cooling fluid 199, second thermal conductor 158 is positioned away from workpiece 190, e.g., having a clearance fit. The clearance fit allows workpiece 190 to protrude through second conductive chiller 150. Yet, when second channel 153 is pressurized with second cooling fluid 199, second thermal conductor 158 is forced against workpiece 190 thereby establishing direct contact and heat transfer. Even with direct contact between second thermal conductor 158 and workpiece 190, annular body 130 or, more specifically, second conductive chiller 150, is able to move relative to workpiece 190.

Referring generally to FIGS. 1A and 1B and particularly to, e.g., FIGS. 3A and 3C, second cooling fluid 199 is a liquid. The preceding subject matter of this paragraph characterizes example 20 of the present disclosure, wherein example 20 also includes the subject matter according to example 19, above.

Liquids generally have higher heat capacities than gases, e.g., 4,186 Jkg$^{-1}$K$^{-1}$ for water vs. 993 Jkg$^{-1}$K$^{-1}$. Furthermore, liquids generally have higher densities than gases, e.g., 1000 kg/m$^3$ for water vs. 1.275 kg/m$^3$. As such, volumetric capacity (considering the space between first conductive chiller 140 and workpiece 190) is much greater for liquids than for gases, more than 3,000 times higher for water than for air. Overall, the same volume of cooling liquid passing through channel 143 results in much higher cooling efficiencies than those associated with cooling gas, assuming the same temperature. One or more examples of the cooling liquid are water, mineral oil, and the like.

Referring generally to FIGS. 1A and 1B and particularly to, e.g., FIGS. 2A, 5, and 6, high-pressure-torsion apparatus 100 further comprises linear actuator 170, coupled to annular body 130 and operable to move heater 160, first conductive chiller 140, and second conductive chiller 150 between first anvil 110 and second anvil 120 along working axis 102. The preceding subject matter of this paragraph characterizes example 21 of the present disclosure, wherein example 21 also includes the subject matter according to any one of examples 1 to 20, above.

High-pressure-torsion apparatus 100 designed to process a portion of workpiece 190 at a time. This portion is defined by operating temperature zone 400 and, in one or more examples, is smaller than a part of workpiece 190, extending between first anvil 110 and second anvil 120 along working axis 102. To process other portions of workpiece 190, heater 160, first conductive chiller 140, and second conductive chiller 150 are moved between first anvil 110 and second anvil 120 along working axis 102. Linear actuator 170 is coupled to annular body 130 to provide this movement.

In one or more examples, linear actuator 170 is configured to move heater 160, first conductive chiller 140, and second conductive chiller 150 in a continuous manner while one or more of heater 160, first conductive chiller 140, and second conductive chiller 150 are operational. The linear speed, with which linear actuator 170 moves heater 160, first conductive chiller 140, and second conductive chiller 150, depends, in part, on the size of operating temperature zone 400 and the processing time for each processed portion. The heating output of heater 160 and the cooling outputs of first conductive chiller 140, and/or second conductive chiller 150 are kept constant while linear actuator 170 moves heater 160, first conductive chiller 140, and second conductive chiller 150.

Alternatively, linear actuator 170 is configured to move heater 160, first conductive chiller 140, and second conductive chiller 150 in an intermittent manner, which can be also referred to as "stop-and-go". In these examples, heater 160, first conductive chiller 140, and second conductive chiller 150 are moved from one location to another location, corresponding to different portions of workpiece 190, and kept stationary in each location while a portion of workpiece 190 corresponding this location is being processed. In more specific examples, at least one of heater 160, first conductive chiller 140, and/or second conductive chiller 150 is not operational while moving from one location to another. At least, the heating output of heater 160 and the cooling outputs of first conductive chiller 140, and/or second conductive chiller 150 are reduced while linear actuator 170 moves heater 160, first conductive chiller 140, and second conductive chiller 150.

Referring generally to FIGS. 1A and 1B and particularly to, e.g., FIG. 2A, high-pressure-torsion apparatus 100 further comprises controller 180, communicatively coupled with linear actuator 170 and configured to control at least one of the position or the translational speed of annular body 130 along working axis 102. The preceding subject matter of this paragraph characterizes example 22 of the present disclosure, wherein example 22 also includes the subject matter according to example 21, above.

Controller 180 is used to ensure that various process parameters associated with modifying material properties of workpiece 190 are kept within predefined ranges. In one or more examples, controller 180 controls at least one of position or translational speed of annular body 130 along working axis 102 to ensure that each portion of workpiece 190, between first anvil 110 and second anvil 120, is processed in accordance with pre-specified processing parameters. For example, the translational speed of annular body 130 determines how long each portion is subjected to the heating action of heater 160 and cooling actions of one or both of first conductive chiller 140 and second conductive chiller 150. Furthermore, in one or more examples, controller 180 controls the heating output of heater 160 and the cooling outputs of first conductive chiller 140 and/or second conductive chiller 150.

Referring generally to FIGS. 1A and 1B and particularly to, e.g., FIG. 2A, high-pressure-torsion apparatus 100 further comprises at least one of heater temperature sensor 169, first-chiller temperature sensor 149, or second-chiller temperature sensor 159, communicatively coupled with controller 180. Heater temperature sensor 169 is configured to measure temperature of portion of surface 194 of workpiece 190, thermally coupled with heater 160. First-chiller temperature sensor 149 is configured to measure temperature of portion of surface 194 of workpiece 190, thermally coupled with first conductive chiller 140. Second-chiller temperature sensor 159 is configured to measure temperature of portion of surface 194 of workpiece 190, thermally coupled with second conductive chiller 150. The preceding subject matter of this paragraph characterizes example 23 of the present disclosure, wherein example 23 also includes the subject matter according to example 22, above.

Controller 180 uses inputs from one or more of heater temperature sensor 169, first-chiller temperature sensor 149, or second-chiller temperature sensor 159 to ensure that workpiece 190 is processed in accordance with desired parameters, such as temperature of the processed portion. Specifically, these inputs are used, in one or more examples, to ensure a particular shape of operating temperature zone 400 within workpiece 190 as, for example, schematically shown in FIG. 4A. In one or more examples, controller 180 controls the heating output of heater 160 and the cooling outputs of first conductive chiller 140 and/or second conductive chiller 150 based on inputs from one or more of heater temperature sensor 169, first-chiller temperature sensor 149, or second-chiller temperature sensor 159.

Referring generally to FIGS. 1A and 1B and particularly to, e.g., FIG. 2A, controller 180 is communicatively coupled with at least one of heater 160, first conductive chiller 140, or second conductive chiller 150. Controller 180 is further configured to control operation of at least one of heater 160, first conductive chiller 140, or second conductive chiller 150 based on input, received from at least one of heater temperature sensor 169, first-chiller temperature sensor 149, or second-chiller temperature sensor 159. The preceding subject matter of this paragraph characterizes example 24 of the present disclosure, wherein example 24 also includes the subject matter according to example 23, above.

Controller 180 uses inputs from one or more of heater temperature sensor 169, first-chiller temperature sensor 149, or second-chiller temperature sensor 159 to control operations of first conductive chiller 140, second conductive chiller 150, and heater 160 thereby establishing a feedback control loop. Different factors impact how much cooling output is needed from each of first conductive chiller 140 and second conductive chiller 150 and how much heating output is needed from heater 160. The feedback control loop enables addressing these factors dynamically, during operation of high-pressure-torsion apparatus 100.

In one or more examples, the output of heater temperature sensor 169 is used to control heater 160, separately from other components. The output of first-chiller temperature sensor 149 is used to control first conductive chiller 140, separately from other components. Finally, the output of second-chiller temperature sensor 159 is used to control second conductive chiller 150, separately from other components. Alternatively, the outputs of heater temperature sensor 169, first-chiller temperature sensor 149, or second-chiller temperature sensor 159 are analyzed collectively by controller 180 for integrated control of first conductive chiller 140, second conductive chiller 150, and heater 160.

Referring generally to FIGS. 1A and 1B and particularly to, e.g., FIG. 2A, controller 180 is further configured to control at least one of the position or the translational speed of annular body 130 along working axis 102. The preceding subject matter of this paragraph characterizes example 25 of the present disclosure, wherein example 25 also includes the subject matter according to example 24, above.

Another example of processing parameters is the processing duration, which is defined as a period of time a portion of workpiece 190 is a part of operating temperature zone 400. Controller 180 controls at least one of the position or the translational speed of annular body 130 along working axis 102 (or both) to ensure that the processing duration is within the desired range. In one or more examples, controller 180 is coupled to linear actuator 170 to ensure this positional control.

Referring generally to FIGS. 1A and 1B and particularly to, e.g., FIGS. 2A, 2B, and 2C, first anvil 110 comprises opening 119 for receiving first end 191 of workpiece 190. Opening 119 has non-circular cross-section in a plane, perpendicular to working axis 102. The preceding subject matter of this paragraph characterizes example 26 of the present disclosure, wherein example 26 also includes the subject matter according to any one of examples 1 to 25, above.

The non-circular cross-section of opening 119 ensures that first anvil 110 is able to engage receiving first end 191 of workpiece 190 and apply torque to first end 191 while twisting workpiece 190 about working axis 102. Specifically, the non-circular cross-section of opening 119 ensures that first end 191 of workpiece 190 does not slip relative to first anvil 110 when torque is applied. The non-circular cross-section effectively eliminates the need for complex non-slip coupling, capable of supporting torque transfer. Referring to FIG. 2B, the non-circular cross-section of opening 119 is oval, in one or more examples. Referring to FIG. 2C, the non-circular cross-section of opening 119 is rectangular, in one or more examples.

Referring generally to FIGS. 1A and 1B and particularly to, e.g., FIG. 2A, heater 160 is one of a resistive heater or an induction heater. The preceding subject matter of this paragraph characterizes example 27 of the present disclosure, wherein example 27 also includes the subject matter according any one of examples 1 to 26, above.

The resistive heater or the induction heater are able to provide high heating output while occupying a small space between first conductive chiller 140 and second conductive chiller 150. The space between first conductive chiller 140 and second conductive chiller 150 determines the height of operating temperature zone 400, which needs to be minimized, in one or more examples. Specifically, a smaller height of operating temperature zone 400 requires lower torque and/or compression between first anvil 110 and second anvil 120.

Referring generally to FIGS. 7A-7C and particularly to, e.g., FIGS. 2A, 4A-4C, 5, and 6, method 800 of modifying material properties of workpiece 190 using high-pressure-torsion apparatus 100 is disclosed. High-pressure-torsion apparatus 100 comprises working axis 102, first anvil 110, second anvil 120, and annular body 130. Annular body 130 comprises first conductive chiller 140, second conductive chiller 150, and heater 160, positioned between first conductive chiller 140 and second conductive chiller 150 along working axis 102. Method 800 comprises (block 810) compressing workpiece 190 along central axis 195 of workpiece 190. Method 800 also comprises, simultaneously with compressing workpiece 190 along central axis 195, (block 820) twisting workpiece 190 about central axis 195. Method 800 additionally comprises, while compressing workpiece 190 along central axis 195 and twisting workpiece 190 about central axis 195, (block 830) translating annular body 130 along working axis 102 of high-pressure-torsion apparatus 100, collinear with central axis 195 of workpiece 190, and (block 840) heating workpiece 190 with heater 160. Method 800 further comprises (block 850) cooling workpiece 190 with at least one of first conductive chiller 140 or second conductive chiller 150, simultaneously with (block 840) heating workpiece 190 with heater 160. The preceding subject matter of this paragraph characterizes example 28 of the present disclosure.

Method 800 utilizes a combination of compression, torque, and heat applied to a portion of workpiece 190, rather than workpiece 190 in its entirety. By heating only a portion of workpiece 190, rather than heating and processing workpiece 190 in its entirety at the same time, all of high-pressure-torsion deformation is confined to the narrow heated layer only, imparting high strains needed for fine-grain development. This reduction in compression and torque translates into a design of high-pressure-torsion apparatus 100 that is less complex and costly. Furthermore, this reduction in compression and torque results in more precise control over processing parameters, such as temperature, compression load, torque, processing duration, and the like. As such, more specific and controlled material microstructures of workpiece 190. For example, ultrafine grained materials offer substantial advantage over coarser grained materials displaying higher strength and better ductility. Finally, high-pressure-torsion apparatus 100 is able to process workpiece 190 having much large dimensions, e.g., a length, extending along working axis 102 of high-pressure-torsion apparatus 100, than would otherwise be possible if workpiece 190 were processed in its entirety at the same time.

A processed portion generally corresponds to a heated portion, defined, at least in part, by the position of heater 160 relative to workpiece 190 and the heating output of heater 160. While the compression and torque is applied to workpiece 190 in its entirety, the modification of material properties primarily happens in the heated portion. More specifically, the modification happens in a processed portion, which has a temperature within a desired processing range, which is defined as operating temperature zone 400. Various examples of operating temperature zone 400 are shown in FIGS. 4A-4C.

A combination of heater 160 and one or both of first conductive chiller 140 and second conductive chiller 150 enable controlling size and position of each processed portion, defined by operating temperature zone 400 as, for example, schematically shown in FIG. 4A. When heater 160 selective heats a portion of workpiece 190, workpiece 190 experiences internal heat transfer, away from the heated portion. Cooling one or both adjacent portions of workpiece 190 enables controlling the effects of this internal heat transfer.

According to method 800, (block 810) compressing workpiece 190 along central axis 195 is performed using first anvil 110 and second anvil 120, engaging and retaining workpiece 190 at respective ends, e.g., first end 191 and second end 192. At least one of first anvil 110 or second anvil 120 is coupled to drive 104 as, for example, schematically shown in FIG. 2A to provide the compression force. The compression force depends on the size of the processed portion (e.g., the height along central axis 195 and the cross-sectional area perpendicular to central axis 195), the material of workpiece 190, the temperature of the processed portion, and other parameters.

According to method 800, (block 820) twisting workpiece 190 about central axis 195 is performed simultaneously with (block 810) compressing workpiece 190 along central axis 195. According to method 800, (block 820) twisting workpiece 190 is also performed using first anvil 110 and second anvil 120. As described above, first anvil 110 and second anvil 120 engage and retain workpiece 190 at respective ends, and at least one of first anvil 110 and second anvil 120 is coupled to drive 104. Torque depends on the size of the processed portion (e.g., the height along central axis 195 and the cross-sectional area, perpendicular to central axis 195), the material of workpiece 190, the temperature of the processed portion, and other parameters.

According to method 800, (block 840) heating workpiece 190 with heater 160 is performed simultaneously with (block 810) compressing and (block 820) twisting workpiece 190. A combination of these steps results in changes of grain structure in at least the processed portion of workpiece 190. It should be noted that the processed portion experiences a higher temperature than the rest of workpiece 190. As such, grain structure changes in the rest of workpiece 190 do not occur or occur to a lesser degree. Furthermore, in one or more examples, (block 830) translating annular body 130 and (block 840) heating workpiece 190 with heater 160 are performed simultaneously with each other. In these examples, processing of workpiece 190 is performed in a continuous manner.

Heater 160 is configured to selectively heat workpiece 190, one portion at a time, either through direct contact with workpiece 190 or radiation. A specific combination of temperature, compression force, and torque, applied to a portion of workpiece, results in changes to gain structure of the material, forming the processed portion. Heater 160 is movable along working axis 102 to process different portions of workpiece 190.

In one or more examples, (block 850) cooling workpiece 190 with first conductive chiller 140 and (block 860) cooling workpiece 190 with second conductive chiller 150 are performed simultaneously. In other words, both first conductive chiller 140 and second conductive chiller 150 are operational at the same time. For example, annular body 130 is positioned away from first anvil 110 and second anvil 120 and heat sinking effects of first anvil 110 and second anvil 120 are negligible when processing portions of workpiece away from first anvil 110 and second anvil 120.

Alternatively, only one first conductive chiller 140 and second conductive chiller 150 is operational while the other one is turned off. In other words, only one of (block 850) cooling workpiece 190 with first conductive chiller 140 and (block 860) cooling workpiece 190 with second conductive chiller 150 is performed, simultaneously with (block 840) heating workpiece 190.

Referring generally to FIGS. 7A-7C and particularly to, e.g., FIGS. 3A-3C, according to method 800, (block 850) cooling workpiece 190 with first conductive chiller 140 comprises (block 852) routing first cooling fluid 198 through first conductive chiller 140 and (block 854) transferring heat from workpiece 190 to first cooling fluid 198 through thermal conductor 148 of first conductive chiller 140. Furthermore, (block 860) cooling workpiece 190 with second conductive chiller 150 comprises (block 862) routing second cooling fluid 199 through second conductive chiller 150 and (block 864) transferring heat from workpiece 190 to second cooling fluid 199 through second thermal conductor 158 of second conductive chiller 150. The preceding subject matter of this paragraph characterizes example 29 of the present disclosure, wherein example 29 also includes the subject matter according to example 28, above.

Thermal conductor 148 provides heat transfer between first cooling fluid 198 and workpiece 190, while fluidically isolating workpiece 190 from first cooling fluid 198. Similarly, second thermal conductor 158 provides heat transfer between second cooling fluid 199 and workpiece 190, while fluidically isolating workpiece 190 from second cooling fluid 199.

When first cooling fluid 198 contacts thermal conductor 148, the temperature of first cooling fluid 198 is less than that of workpiece 190. This temperature gradient results in heat transfer through thermal conductor 148 and cooling a portion of workpiece 190, which is thermal contact or even in direct contact with thermal conductor 148. It should be noted that another portion of workpiece 190 is heated adjacent to this cooled portion and that workpiece 190 experiences internal heat transfer between the heated portion and the cooled portion. Similarly, when second cooling fluid 199 contacts second thermal conductor 158, the temperature of second cooling fluid 199 is less than that of workpiece 190. This temperature gradient results in heat transfer through second thermal conductor 158 and cooling of another portion of workpiece 190. The heated portion of workpiece 190 is also adjacent to this second cooled portion. In one or more examples, the heated portion is positioned between two cooled portions.

Referring generally to FIGS. 7A-7C and particularly to, e.g., FIGS. 4A-4C, according to method 800, (block 852) routing first cooling fluid 198 through first conductive chiller 140 and (block 862) routing second cooling fluid 199 through second conductive chiller 150 are independently controlled. The preceding subject matter of this paragraph characterizes example 30 of the present disclosure, wherein example 30 also includes the subject matter according to example 29, above.

Independent control of first conductive chiller 140 and second conductive chiller 150 provides different cooling outputs from first conductive chiller 140 and second conductive chiller 150. These different cooling outputs allow better control of the processing parameters, such as the shape of operating temperature zone 400 as schematically shown, for example, in FIGS. 4A-4C.

In one or more examples, shown in FIG. 4A, both first conductive chiller 140 and second conductive chiller 150 are operational, such that first cooling fluid 198 flows through first conductive chiller 140 and second cooling fluid 199 flows through second conductive chiller 150 at the same time. In specific examples, flow rates of first cooling fluid 198 and second cooling fluid 199 are the same. Alternatively, the flow rates are different. As such, in one or more examples, the flow rates of first cooling fluid 198 and second cooling fluid 199 are independently controlled.

In other examples, only one first conductive chiller 140 and second conductive chiller 150 is operational. FIG. 4B illustrates an example where only first conductive chiller 140 is operational while second conductive chiller 150 is not operational. In this example, first cooling fluid 198 flows through first conductive chiller 140 while second cooling fluid 199 does not flow through second conductive chiller 150. FIG. 4C illustrates another example where only second conductive chiller 150 is operational while first conductive chiller 140 is not operational. In this example, second cooling fluid 199 flows through second conductive chiller 150 while first cooling fluid 198 does not flow through first conductive chiller 140.

Referring generally to FIGS. 7A-7C and particularly to, e.g., FIGS. 3A-3C, according to method 800, each of first cooling fluid 198 and second cooling fluid 199 is a liquid. The preceding subject matter of this paragraph characterizes example 31 of the present disclosure, wherein example 31 also includes the subject matter according to example 29 or 30, above.

Liquids generally have higher heat capacities than gases, e.g., 4,186 $Jkg^{-1}K^{-1}$ for water vs. 993 $Jkg^{-1}K^{-1}$. Furthermore, liquids generally have higher densities than gases, e.g., 1000 $kg/m^3$ for water vs. 1.275 $kg/m^3$. As such, volumetric capacity (considering the space between first conductive chiller 140 and workpiece 190) is much greater for liquids than for gases, more than 3,000 times higher for water than for air. Overall, the same volume of cooling liquid, passing through channel 143, results in much higher cooling efficiencies than those provided by cooling gas, assuming the same temperature. One or more examples of the cooling liquid are water, mineral oil, and the like.

Referring generally to FIGS. 7A-7C and particularly to, e.g., FIGS. 3A-3C, according to method 800, annular body 130 comprises central opening 147, at least partially formed by thermal conductor 148 of first conductive chiller 140 and second thermal conductor 158 of second conductive chiller 150. Furthermore, (block 854) transferring heat from workpiece 190 to first cooling fluid 198 through thermal conductor 148 of first conductive chiller 140 comprises (block 856) contacting workpiece 190, protruding through central opening 147 with thermal conductor 148 of first conductive chiller 140. Furthermore, (block 864) transferring heat from workpiece 190 to second cooling fluid 199 through second thermal conductor 158 of second conductive chiller 150 comprises (block 866) contacting workpiece 190, protruding through central opening 147, with second thermal conductor 158 of second conductive chiller 150. The preceding subject matter of this paragraph characterizes example 32 of the present disclosure, wherein example 32 also includes the subject matter according to example 31, above.

Central opening 147 enables workpiece 190 to protrude through annular body 130 such that annular body 130 surrounds workpiece 190. As such, components of annular body 130 have access to the entire perimeter of workpiece 190. Specifically, first conductive chiller 140 is operable to selectively cool a portion of workpiece 190 around the entire perimeter of workpiece 190 by directing first cooling fluid 198 to thermal conductor 148 forming a part of central opening 147. Similarly, heater 160 is operable to selectively heat another portion of workpiece 190 around the entire perimeter of workpiece 190. Finally, second conductive chiller 150 is operable to selectively cool yet another portion of workpiece 190 around the entire perimeter of workpiece 190 by directing second cooling fluid 199 to second thermal conductor 158, forming yet another part of central opening 147.

In one or more examples, at least heater 160 and workpiece 190 have clearance fit to allow for heater 160 to freely move relative to workpiece 190, especially when workpiece 190 radially expands during heating. More specifically, the gap between heater 160 and workpiece 190, in the radial direction, is between 1 millimeter and 10 millimeters wide, around the entire perimeter or, more specifically, between 2 millimeters and 8 millimeters. In specific examples, the gap is uniform around the entire perimeter. Furthermore, in one or more examples, thermal conductor 148 and/or second thermal conductor 158 have a clearance fit with workpiece 190 have clearance, at least before first cooling fluid 198 and/or second cooling fluid 199 is pressurized in a corresponding channel.

Referring generally to FIGS. 7A-7C and particularly to, e.g., FIGS. 3A and 3B, according to method 800, first conductive chiller 140 comprises channel 143, comprising inlet 144, outlet 145, and intermediate portion 146, which is in fluidic communication with inlet 144 and outlet 145. Furthermore, (block 854) transferring heat from workpiece 190 to first cooling fluid 198 through thermal conductor 148 of first conductive chiller 140 comprises (block 858) flowing first cooling fluid 198 from inlet 144 of channel 143, through intermediate portion 146 of channel 143, and into outlet 145 of channel 143. Thermal conductor 148 fluidically isolates intermediate portion 146 of channel 143 from central opening 147 of annular body 130. The preceding subject matter of this paragraph characterizes example 33 of the present disclosure, wherein example 33 also includes the subject matter according to example 32, above.

Referring to FIGS. 3A and 3B, when first conductive chiller 140 is operational, first cooling fluid 198 is supplied into channel 143, through inlet 144. First cooling fluid 198 flows through channel 143 and exits through outlet 145. The temperature of first cooling fluid 198 is less than that of workpiece 190. First cooling fluid 198 contacts thermal conductor 148, which transfer heat from a portion of workpiece 190 to first cooling fluid 198, resulting in cooling of that portion. Thermal conductor 148 prevents direct contact between first cooling fluid 198 and workpiece 190 and also seals first cooling fluid 198 within channel 143.

Inlet 144 is configured to connect to a cooling-fluid source, such as a line or conduit, a compressed-gas cylinder, a pump, and the like. In one or more examples, the flow rate of first cooling fluid 198 is controlled.

Referring generally to FIGS. 7A-7C and particularly to, e.g., FIGS. 3A and 3C, according to method 800, second conductive chiller 150 comprises second channel 153, comprising second inlet 154, second outlet 155, and second intermediate portion 156, which is in fluidic communication with second inlet 154 and second outlet 155. Furthermore, (block 864) transferring heat from workpiece 190 to second cooling fluid 199 through second thermal conductor 158 of second conductive chiller 150 comprises (block 868) flowing second cooling fluid 199 from second inlet 154 of second channel 153, through second intermediate portion 156 of second channel 153, and into second outlet 155 of second channel 153. Second thermal conductor 158 of second conductive chiller 150 fluidically isolates second intermediate portion 156 of second channel 543 from central opening 147 of annular body 130. The preceding subject matter of this paragraph characterizes example 34 of the present disclosure, wherein example 34 also includes the subject matter according to example 32 or 33, above.

Referring to FIGS. 3A and 3C, when second conductive chiller 150 is operational, second cooling fluid 199 is supplied into second channel 153, through second inlet 154. Second cooling fluid 199 flows through second channel 153 and exits through second outlet 155. The temperature of second cooling fluid 199 is less than that of workpiece 190. Second cooling fluid 199 contacts second thermal conductor 158, which transfer heat from a portion of workpiece 190 to second cooling fluid 199, resulting in cooling of that portion. Second thermal conductor 158 prevents direct contact between second cooling fluid 199 and workpiece 190 and also seals second cooling fluid 199 within second channel 153.

Second inlet 154 is configured to connect to a cooling-fluid source, such as a line or conduit, a compressed-gas cylinder, a pump, and the like. In one or more examples, the flow rate of second cooling fluid 199 is controlled.

Referring generally to FIGS. 7A-7C and particularly to, e.g., FIG. 3C, according to method 800, second intermediate portion 156 of second channel 153 has a closed shape and surrounds working axis 102. The preceding subject matter of this paragraph characterizes example 35 of the present disclosure, wherein example 35 also includes the subject matter according to example 34, above.

Second intermediate portion 156 surrounds workpiece 190 such that a portion of workpiece 190, facing second conductive chiller 150, is uniformly cooled around the perimeter of this portion. Second cooling fluid 199 flows through second intermediate portion 156, between second inlet 154 and second outlet 155.

Referring generally to FIGS. 7A-7C and particularly to, e.g., FIGS. 3A-3C, according to method 800, (block 854) transferring heat from workpiece 190 to first cooling fluid 198 through thermal conductor 148 of first conductive chiller 140 comprises (block 857) flexing thermal conductor 148 toward working axis 102 and (block 859) directly contacting workpiece 190 with thermal conductor 148. Furthermore, (block 864) transferring heat from workpiece 190 to second cooling fluid 199 through second thermal conductor 158 of second conductive chiller 150 comprises (block 867) flexing second thermal conductor 158 toward working axis 102 and (block 869) directly contacting workpiece 190 with second thermal conductor 158. The preceding subject matter of this paragraph characterizes example 36 of the present disclosure, wherein example 36 also includes the subject matter according to any one examples 29 to 35, above.

The flexibility of thermal conductor 148 ensures that thermal conductor 148 is able to ensure direct contact with workpiece 190 and efficient heat transfer through this direct contact. In one or more examples, before channel 143 is pressurized with first cooling fluid 198, thermal conductor 148 is positioned away from workpiece 190, e.g., having a clearance fit. The clearance fit enables workpiece 190 to protrude through first conductive chiller 140. Yet, when channel 143 is pressurized with first cooling fluid 198, thermal conductor 148 is forced against workpiece 190 thereby establishing direct contact and heat transfer. Even with the direct contact between thermal conductor 148 and workpiece 190, annular body 130 or, more specifically, first conductive chiller 140, is able to move relative to workpiece 190.

The flexibility of second thermal conductor 158 ensures that second thermal conductor 158 is able to ensure direct contact with workpiece 190 and efficient heat transfer through this direct contact. In one or more examples, before second channel 153 is pressurized with second cooling fluid 199, second thermal conductor 158 is positioned away from workpiece 190, e.g., having a clearance fit. The clearance fit enables workpiece 190 to protrude through second conductive chiller 150. Yet, when second channel 153 is pressurized with second cooling fluid 199, second thermal conductor 158 is forced against workpiece 190 thereby establishing direct contact and heat transfer. Even with direct contact between second thermal conductor 158 and workpiece 190, annular body 130 or, more specifically, second conductive chiller 150, is able to move relative to workpiece 190.

Referring generally to FIGS. 7A-7C and particularly to, e.g., FIGS. 3A-3C, according to method 800, (block 857) flexing thermal conductor 148 toward working axis 102 comprises (block 852) routing first cooling fluid 198 through first conductive chiller 140. Furthermore, (block 867) flexing second thermal conductor 158 toward working axis 102 comprises (block 862) routing second cooling fluid 199 through second conductive chiller 150. The preceding subject matter of this paragraph characterizes example 37 of the present disclosure, wherein example 37 also includes the subject matter according to example 36, above.

The flexibility of thermal conductor 148 ensures that thermal conductor 148 is able to ensure direct contact with workpiece 190 and efficient heat transfer through this direct contact. In one or more examples, before channel 143 is pressurized with first cooling fluid 198, thermal conductor 148 is positioned away from workpiece 190, e.g., having a clearance fit. The clearance fit enables workpiece 190 to protrude through first conductive chiller 140. Yet, when channel 143 is pressurized with first cooling fluid 198, thermal conductor 148 is forced against workpiece 190 thereby establishing direct contact and heat transfer. Even with direct contact between thermal conductor 148 and workpiece 190, annular body 130 or, more specifically, first conductive chiller 140 is able to move relative to workpiece 190.

The flexibility of second thermal conductor 158 ensures that second thermal conductor 158 is able to ensure direct contact with workpiece 190 and efficient heat transfer through this direct contact. In one or more examples, before second channel 153 is pressurized with second cooling fluid 199, second thermal conductor 158 is positioned away from workpiece 190, e.g., having a clearance fit. The clearance fit enables workpiece 190 to protrude through second conductive chiller 150. Yet, when second channel 153 is pressurized with second cooling fluid 199, second thermal conductor 158 is forced against workpiece 190 thereby establishing direct contact and heat transfer. Even with direct contact between second thermal conductor 158 and workpiece 190, annular body 130 or, more specifically, second conductive chiller 150 is able to move relative to workpiece 190.

Referring generally to FIGS. 7A-7C and particularly to, e.g., FIGS. 4A-4C, according to method 800, (block 840) heating workpiece 190 with heater 160 is independent from (block 850) cooling workpiece 190 with at least one of first conductive chiller 140 or second conductive chiller 150. The preceding subject matter of this paragraph characterizes example 38 of the present disclosure, wherein example 38 also includes the subject matter according to any one examples 28 to 37, above.

The shape of operating temperature zone 400, schematically shown in FIGS. 4A-4C, is controlled, at least in part, by heating and cooling outputs of heater 160, first conductive chiller 140, and second conductive chiller 150. Independent operations of heater 160, first conductive chiller 140, and second conductive chiller 150 allow for more precise control of operating temperature zone 400. For examples, some portions of workpiece 190 are processed with all three of heater 160, first conductive chiller 140, and second conductive chiller 150 being operational. In other examples, other portions, e.g., proximate to first anvil 110 or second anvil 120, are processed with one of first conductive chiller 140 or second conductive chiller 150 being turned off.

Operations of first conductive chiller 140 and second conductive chiller 150 are individually controlled. Furthermore, cooling output of first conductive chiller 140 is controllably variable. Likewise, cooling output of second conductive chiller 150 is controllably variable.

Referring generally to FIGS. 7A-7C and particularly to, e.g., FIGS. 4B and 4C, according to method 800, (block 840) heating workpiece 190 with heater 160 is performed while workpiece 190 is not cooled by at least one of first conductive chiller 140 or second conductive chiller 150. The preceding subject matter of this paragraph characterizes example 39 of the present disclosure, wherein example 39 also includes the subject matter according to example 38, above.

The shape of operating temperature zone 400, schematically shown in FIGS. 4B and 4C, is controlled, at least in part, by heating and cooling actions of heater 160, first conductive chiller 140, and second conductive chiller 150. The shape is also controlled by heat transfer within workpiece 190 and between workpiece 190 and other components, engaging workpiece 190, such as first anvil 110 and second anvil 120. Referring to FIG. 4B, when heater 160 heats a portion of workpiece 190 positioned near or even engaged by second anvil 120, second anvil 120 also operates as a heat sink, resulting in heat transfer from workpiece 190 to second anvil 120. In this example, second conductive chiller 150, which is positioned closer to second anvil 120 than heater 160 or which is already positioned around second anvil 120 as shown in FIG. 4B, is turned off and not cooling workpiece 190. Alternatively, referring to FIG. 4C, second conductive chiller 150, which is positioned closer to second anvil 120 than heater 160 or which is already positioned around second anvil 120, is turned on and cooling second anvil 120, e.g., to prevent damage to second anvil 120.

Operation of first conductive chiller 140 and second conductive chiller 150 is individually controlled. In one example, both first conductive chiller 140 and second conductive chiller 150 are operational and cooling respective portions of workpiece 190. In another example, one of first conductive chiller 140 and second conductive chiller 150 is operational while the other one of first conductive chiller 140 and second conductive chiller 150 is not operational. For example, first conductive chiller 140 is not operational while second conductive chiller 150 is operational, e.g., when annular body 130 approaches first anvil 110 and/or when first anvil 110 at least partially protrudes through annular body 130. Alternatively, first conductive chiller 140 is operational while second conductive chiller 150 is not operational, e.g., when annular body 130 approaches second anvil 120 and/or when second anvil 120 at least partially protrudes through annular body 130. Furthermore, in one or more examples, both first conductive chiller 140 and second conductive chiller 150 are not operational while heater 160 is operational. In one or more examples, operation of each of first conductive chiller 140 and second conductive chiller 150 is controlled based on position of annular body 130 (e.g., relative to first anvil 110 or second anvil 120) and/or temperature feedback, as further described below. Furthermore, cooling output of first conductive chiller 140 is controllably variable. Likewise, cooling output of second conductive chiller 150 is controllably variable.

Referring generally to FIGS. 7A-7C and particularly to, e.g., FIG. 3A, method 800 further comprises (block 870) thermally conductively isolating heater 160 from first conductive chiller 140 from each other using first thermal barrier 137 while (block 840) heating workpiece 190 with heater 160 is performed simultaneously with (block 850) cooling workpiece 190 with first conductive chiller 140. The preceding subject matter of this paragraph characterizes example 40 of the present disclosure, wherein example 40 also includes the subject matter according to any one examples 28 to 39, above.

First thermal barrier 137 reduces heat transfer between heater 160 and first conductive chiller 140 thereby improving heating efficiency of heater 160 and cooling efficiency of first conductive chiller 140. In one or more examples, first thermal barrier 137 is formed from a heat-insulating material, e.g., a material with a thermal conductivity of less than 1 W/m*K. Some examples of suitable material for first thermal barrier 137 are fiberglass, mineral wool, cellulose, polymer foams (e.g., polyurethane foam, polystyrene foam). In one or more examples, the thickness of first thermal barrier 137 is small, e.g., less than 10 millimeters or even less than 5 millimeters. The small thickness of first thermal barrier 137 and/or second thermal barrier 138 ensures that the distance between heater 160 and first conductive chiller 140 is small, thereby reducing the height of operating temperature zone 400.

Referring generally to FIGS. 7A-7C and particularly to, e.g., FIG. 3A, according to method 800, first thermal barrier 137 contacts workpiece 190. The preceding subject matter of this paragraph characterizes example 41 of the present disclosure, wherein example 41 also includes the subject matter according to example 40, above.

First thermal barrier 137 reduces heat transfer between heater 160 and first conductive chiller 140 thereby improving heating efficiency of heater 160 and cooling efficiency of first conductive chiller 140, especially at the interface with workpiece 190.

In one or more examples, first thermal barrier 137 is formed from a heat-insulating material, e.g., a material with a thermal conductivity of less than of less than 1 W/m*K. Some examples of suitable material are fiberglass, mineral wool, cellulose, polymer foams (e.g., polyurethane foam, polystyrene foam). In one or more examples, the thickness of first thermal barrier 137 is small, e.g., less than 10 millimeters or even less than 5 millimeters to ensure that the distance between heater 160 and first conductive chiller 140 is small. The proximity of first conductive chiller 140 to heater 160 ensures that the height (axial dimension) of operating temperature zone 400 is small.

Referring generally to FIGS. 7A-7C and particularly to, e.g., FIG. 3A, method 800 further comprises (block 875) thermally conductively isolating heater 160 from second conductive chiller 150 from each other using second thermal barrier 138 while (block 840) heating workpiece 190 with heater 160 is performed simultaneously with (block 860) cooling workpiece 190 with second conductive chiller 150. The preceding subject matter of this paragraph characterizes example 42 of the present disclosure, wherein example 42 also includes the subject matter according to any one examples 28 to 41, above.

Second thermal barrier 138 reduces heat transfer between heater 160 and second conductive chiller 150 thereby improving heating efficiency of heater 160 and cooling efficiency of second conductive chiller 150. In one or more examples, second thermal barrier 138 is formed from a heat-insulating material, e.g., a material with a thermal conductivity of less than 1 W/m*K. Some examples of suitable material for second thermal barrier 138 are fiberglass, mineral wool, cellulose, polymer foams (e.g., polyurethane foam, polystyrene foam). In one or more examples, the thickness of second thermal barrier 138 is small, e.g., less than 10 millimeters or even less than 5 millimeters. The small thickness of second thermal barrier 138 ensures that the distance between heater 160 and second conductive chiller 150 are small thereby reducing the height of operating temperature zone 400.

Referring generally to FIGS. 7A-7C and particularly to, e.g., FIG. 3A, according to method 800, second thermal barrier 138 contacts workpiece 190. The preceding subject matter of this paragraph characterizes example 43 of the present disclosure, wherein example 43 also includes the subject matter according to example 42, above.

Second thermal barrier 138 reduces heat transfer between heater 160 and second conductive chiller 150 thereby improving heating efficiency of heater 160 and cooling efficiency of second conductive chiller 150. In one or more examples, second thermal barrier 138 is formed from a heat-insulating material, e.g., a material with a thermal conductivity of less than of less than 1 W/m*K. Some examples of suitable material are fiberglass, mineral wool, cellulose, polymer foams (e.g., polyurethane foam, polystyrene foam). In one or more examples, the thickness of second thermal barrier 138 is small, e.g., less than 10 millimeters or even less than 5 millimeters to ensure that the distance between heater 160 and second conductive chiller 150 are small. The proximity of second conductive chiller 150 to heater 160 ensures that the height (axial dimension) of operating temperature zone 400 is small.

Referring generally to FIGS. 7A-7C and particularly to, e.g., FIG. 2A, method 800 further comprises (block 880) receiving, at controller 180 of high-pressure-torsion apparatus 100, input from heater temperature sensor 169, first-chiller temperature sensor 149, and second-chiller temperature sensor 159. Each of heater temperature sensor 169, first-chiller temperature sensor 149, and second-chiller temperature sensor 159 is communicatively coupled with controller 180. Method 800 further comprises (block 885) controlling, using controller 180, operations of at least one of heater 160, first conductive chiller 140, or second conductive chiller 150 based on input from heater temperature sensor 169, first-chiller temperature sensor 149, and second-chiller temperature sensor 159. Each of heater 160, first conductive chiller 140, and second conductive chiller 150 is communicatively coupled with and controlled by controller 180. The preceding subject matter of this paragraph characterizes example 44 of the present disclosure, wherein example 44 also includes the subject matter according to any one examples 28 to 43, above.

Controller 180 is used to ensure that various process parameters associated with modifying material properties of workpiece 190 are kept within predefined ranges. Specifically, controller 180 uses inputs from one or more of heater temperature sensor 169, first-chiller temperature sensor 149, or second-chiller temperature sensor 159 to ensure that workpiece 190 is processed in accordance with desired parameters, such as temperature of the processed portion. Specifically, these inputs are used, in one or more examples, to ensure a particular shape of operating temperature zone 400.

In one or more examples, the output of heater temperature sensor 169 is used to control heater 160, separately from other components. The output of first-chiller temperature sensor 149 is used to control first conductive chiller 140, separately from other components. Finally, the output of second-chiller temperature sensor 159 is used to control second conductive chiller 150, separately from other components. Alternatively, outputs of heater temperature sensor 169, first-chiller temperature sensor 149, or second-chiller temperature sensor 159 are analyzed collectively by controller 180 for integrated control of first conductive chiller 140, second conductive chiller 150, and heater 160.

Referring generally to FIGS. 7A-7C and particularly to, e.g., FIGS. 2A, 5, and 6, according to method 800, (block 830) translating annular body 130 along working axis 102 of high-pressure-torsion apparatus 100 is performed using linear actuator 170, communicatively coupled to and controlled by controller 180. The preceding subject matter of this paragraph characterizes example 45 of the present disclosure, wherein example 45 also includes the subject matter according to example 44, above.

Heater 160, first conductive chiller 140, and second conductive chiller 150 are designed to process a portion of workpiece 190 at a time. This portion is defined by operating temperature zone 400 and, in one or more examples, is smaller than a part of workpiece 190, extending between first anvil 110 and second anvil 120 along working axis 102. To process additional portions of workpiece 190, heater 160, first conductive chiller 140, and second conductive chiller 150 are moved between first anvil 110 and second anvil 120 along working axis 102 using linear actuator 170.

In one or more examples, linear actuator 170 is configured to move heater 160, first conductive chiller 140, and second conductive chiller 150 in a continuous manner while one or more of heater 160, first conductive chiller 140, and second conductive chiller 150 are operational. The linear speed, with which linear actuator 170 moves heater 160, first conductive chiller 140, and second conductive chiller 150, depends, in part, on the desired size of operating temperature zone 400 and the processing time, required for each processed portion.

Alternatively, linear actuator 170 is configured to move heater 160, first conductive chiller 140, and second conductive chiller 150 in an intermittent manner, which can be also called a "stop-and-go" manner. In these examples, heater 160, first conductive chiller 140, and second conductive chiller 150 are moved from one location to another location, corresponding to different portions of workpiece 190, and are kept stationary in each location while the corresponding portion of the workpiece is being processed. In more specific examples, at least one of heater 160, first conductive chiller 140, and/or second conductive chiller 150 is not operational while moving from one location to another.

Referring generally to FIGS. 7A-7C and particularly to, e.g., FIGS. 2A, 5, and 6, method 800 further comprises (block 890) engaging first end 191 of workpiece 190 with first anvil 110 of high-pressure-torsion apparatus 100. Method 800 further comprises (block 895) engaging second end 192 of workpiece 190 with second anvil 120 of high-pressure-torsion apparatus 100. Furthermore, (block 810) compressing workpiece 190 along central axis 195 of workpiece 190 and (block 820) twisting workpiece 190 about central axis 195 are performed using first anvil 110 and second anvil 120. The preceding subject matter of this paragraph characterizes example 46 of the present disclosure, wherein example 46 also includes the subject matter according to any one examples 28 to 45, above.

Method 800 utilizes a combination of compression, torque, and heat applied to a portion of workpiece 190, rather than workpiece 190 in its entirety. By heating only a portion of workpiece 190, rather than heating and processing workpiece 190 in its entirety at the same time, all of high-pressure-torsion deformation is confined to the narrow heated layer only, imparting high strains needed for fine-grain development. This reduction in compression and torque translates into a design of high-pressure-torsion apparatus 100 that is less complex and costly. Furthermore, this reduction in compression and torque results in more precise control over processing parameters, such as temperature, compression load, torque, processing duration, and the like. As such, more specific and controlled material microstructures of workpiece 190.

According to method 800, (block 810) compressing workpiece 190 along central axis 195 is performed using first anvil 110 and second anvil 120, engaging and retaining workpiece 190 at respective ends, e.g., first end 191 and second end 192. At least one of first anvil 110 and second anvil 120 is coupled to drive 104 as, for example, schematically shown in FIG. 2A to provide the compression force. The compression force depends on the size of the processed portion (e.g., the height along central axis 195 and the cross-sectional area perpendicular to central axis 195), the material of workpiece 190, and other parameters. Similarly, (block 820) twisting workpiece 190 about central axis 195 is performed using first anvil 110 and second anvil 120, engaging and retaining workpiece 190 at respective ends, e.g., first end 191 and second end 192. Torque depends on the size of the processed portion (e.g., the length along central axis 195 and the cross-sectional area perpendicular to central axis 195), the material of workpiece 190, and other parameters.

Referring generally to FIGS. 7A-7C and particularly to, e.g., FIG. 5, according to method 800, first anvil 110 comprises base 117 and protrusion 115, extending from base 117 toward second anvil 120 along working axis 102. Annular body 130 comprises central opening 147. Furthermore, (block 830) translating annular body 130 along working axis 102 of high-pressure-torsion apparatus 100 comprises (block 832) advancing protrusion 115 of first anvil 110 into central opening 147 of annular body 130. The preceding subject matter of this paragraph characterizes example 47 of the present disclosure, wherein example 47 also includes the subject matter according to example 46, above.

The diameter of protrusion 115 being smaller than the diameter of central opening 147 of annular body 130 enables protrusion 115 to protrude into central opening 147, e.g., when annular body 130 is advanced toward first-anvil base 117 as, for example, schematically shown in FIG. 5. This feature enables maximizing the processed length of workpiece 190. Specifically, in one or more examples, any portion of workpiece 190, extending between first anvil 110 and second anvil 120, is accessible to each processing component of annular body 130.

In one or more examples, the diameter of protrusion 115 is the same as the diameter of the portion of workpiece 190, extending between first anvil 110 and second anvil 120 and not engaged by first anvil 110 and second anvil 120. This ensures continuity of the seal when first conductive chiller 140 faces protrusion 115, e.g., past external interface point 193 between protrusion 115 and workpiece 190.

Referring generally to FIGS. 7A-7C and particularly to, e.g., FIG. 5, according to method 800, (block 850) cooling workpiece 190 with first conductive chiller 140 is discontinued while (block 832) advancing protrusion 115 of first anvil 110 into central opening 147 of first conductive chiller 140. The preceding subject matter of this paragraph characterizes example 48 of the present disclosure, wherein example 48 also includes the subject matter according to example 47, above.

First anvil 110 operates as a heat sink when a heated portion of workpiece 190 is proximate to first anvil 110, such as when protrusion 115 is advanced into central opening 147 of first conductive chiller 140. To preserve the shape of operating temperature zone 400, (block 850) cooling workpiece 190 with first conductive chiller 140 is discontinued. The effect of the internal heat transfer is mitigated by first anvil 110 at that point. Operation of first conductive chiller 140 and second conductive chiller 150 is individually controlled.

Referring generally to FIGS. 7A-7C and particularly to, e.g., FIG. 6, according to method 800, second anvil 120 comprises second base 127 and second protrusion 125, extending from second base 127 toward first anvil 110 along working axis 102. Annular body 130 comprises central opening 147. Furthermore, (block 830) translating annular body 130 along working axis 102 of high-pressure-torsion apparatus 100 comprises (block 834) advancing second protrusion 125 of second anvil 120 into central opening 147 of annular body 130. The preceding subject matter of this paragraph characterizes example 49 of the present disclosure, wherein example 49 also includes the subject matter according to any one examples 46 to 48, above.

The diameter of second protrusion 125, being smaller than the diameter of central opening 147 of annular body 130, enables second protrusion 125 to protrude into central opening 147, e.g., when annular body 130 is advanced toward second-anvil base 127 as, for example, schematically shown in FIG. 5. This feature enables maximizing the processed length of workpiece 190. Specifically, in one or more examples, any portion of workpiece 190, extending between first anvil 110 and second anvil 120, is accessible to each processing component of annular body 130.

In one or more examples, the diameter of second protrusion 125 is the same as the diameter of the portion of workpiece 190, extending between first anvil 110 and second anvil 120 and not engaged by first anvil 110 and second anvil 120. This ensures sealing and other characteristics of high-pressure-torsion apparatus 100.

Referring generally to FIGS. 7A-7C and particularly to, e.g., FIG. 6, according to method 800, (block 860) cooling workpiece 190 with second conductive chiller 150 is discontinued while (block 834) advancing second protrusion 125 of second anvil 120 into central opening 147 of second conductive chiller 150. The preceding subject matter of this paragraph characterizes example 50 of the present disclosure, wherein example 50 also includes the subject matter according to example 49, above.

Second anvil 120 operates as a heat sink when a heated portion of workpiece 190 is proximate to second anvil 120, such as when second protrusion 125 is advanced into central opening 147 of second conductive chiller 150. To preserve the shape of operating temperature zone 400, (block 860) cooling workpiece 190 with second conductive chiller 150 is discontinued. The effect of the internal heat transfer is mitigated by second anvil 120 at that point. Operation of first conductive chiller 140 and second conductive chiller 150 is individually controlled.

Referring generally to FIGS. 7A-7C and particularly to, e.g., FIGS. 2A-2C, according to method 800, first anvil 110 comprises opening 119, engaging first end 191 of workpiece 190. Opening 119 has a non-circular cross-section in a plane, perpendicular to working axis 102. The preceding subject matter of this paragraph characterizes example 51 of the present disclosure, wherein example 51 also includes the subject matter according to any one examples 46 to 50, above.

The non-circular cross-section of opening 119 ensures that first anvil 110 is able to engage receiving first end 191 of workpiece 190 and apply torque to first end 191 while twisting workpiece 190 about working axis 102. Specifically, the non-circular cross-section of opening 119 ensures that first end 191 of workpiece 190 does not slip relative to first anvil 110 when torque is applied. The non-circular cross-section effectively eliminates the need for complex non-slip coupling, capable of supporting torque transfer.

Referring to FIG. 2B, the non-circular cross-section of opening 119 is oval, in one or more examples. Referring to FIG. 2C, the non-circular cross-section of opening 119 is rectangular, in one or more examples.

Referring generally to FIGS. 7A-7C and particularly to, e.g., FIGS. 2A, 2D, and 2E, according to method 800, second anvil 120 comprises second opening 129, engaging second end 192 of workpiece 190. Second opening 129 has non-circular cross-section in a plane, perpendicular to working axis 102. The preceding subject matter of this paragraph characterizes example 52 of the present disclosure, wherein example 52 also includes the subject matter according to any one examples 46 to 51, above.

The non-circular cross-section of second opening 129 ensures that second anvil 120 is able to engage receiving second end 192 of workpiece 190 and apply torque to second end 192 while twisting workpiece 190 about working axis 102. Specifically, the non-circular cross-section of second opening 129 ensures that second end 192 of workpiece 190 does not slip relative to second anvil 120 when torque is applied. The non-circular cross-section effectively eliminates the need for complex non-slip coupling, capable of supporting torque transfer.

Referring to FIG. 2D, the non-circular cross-section of second opening 129 is oval, in one or more examples. Referring to FIG. 2E, the non-circular cross-section of second opening 129 is rectangular, in one or more examples.

Examples of the present disclosure may be described in the context of aircraft manufacturing and service method 1100 as shown in FIG. 8 and aircraft 1102 as shown in FIG. 9. During pre-production, illustrative method 1100 may include specification and design (block 1104) of aircraft 1102 and material procurement (block 1106). During production, component and subassembly manufacturing (block 1108) and system integration (block 1110) of aircraft 1102 may take place. Thereafter, aircraft 1102 may go through certification and delivery (block 1112) to be placed in service (block 1114). While in service, aircraft 1102 may be scheduled for routine maintenance and service (block 1116). Routine maintenance and service may include modification, reconfiguration, refurbishment, etc. of one or more systems of aircraft 1102.

Each of the processes of illustrative method 1100 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 9, aircraft 1102 produced by illustrative method 1100 may include airframe 1118 with a plurality of high-level systems 1120 and interior 1122. Examples of high-level systems 1120 include one or more of propulsion system 1124, electrical system 1126, hydraulic system 1128, and environmental system 1130. Any number of other systems may be included. Although an aerospace example is shown, the principles disclosed herein may be applied to other industries, such as the automotive industry. Accordingly, in addition to aircraft 1102, the principles disclosed herein may apply to other vehicles, e.g., land vehicles, marine vehicles, space vehicles, etc.

Apparatus(es) and method(s) shown or described herein may be employed during any one or more of the stages of the manufacturing and service method 1100. For example, components or subassemblies corresponding to component and subassembly manufacturing (block 1108) may be fabricated or manufactured in a manner similar to components or subassemblies produced while aircraft 1102 is in service (block 1114). Also, one or more examples of the apparatus(es), method(s), or combination thereof may be utilized during production stages 1108 and 1110, for example, by substantially expediting assembly of or reducing the cost of aircraft 1102. Similarly, one or more examples of the apparatus or method realizations, or a combination thereof, may be utilized, for example and without limitation while aircraft 1102 is in service (block 1114) and/or during maintenance and service (block 1116).

Different examples of the apparatus(es) and method(s) disclosed herein include a variety of components, features, and functionalities. It should be understood that the various examples of the apparatus(es) and method(s) disclosed herein may include any of the components, features, and functionalities of any of the other examples of the apparatus(es) and method(s) disclosed herein in any combination, and all of such possibilities are intended to be within the scope of the present disclosure.

Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples illustrated and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims. Accordingly, parenthetical reference numerals in the appended claims are presented for illustrative purposes only and are not intended to limit the scope of the claimed subject matter to the specific examples provided in the present disclosure.

What is claimed is:

1. A method of modifying material properties of a workpiece using a high-pressure-torsion apparatus, the high-pressure-torsion apparatus comprising a working axis, a first anvil, a second anvil, and an annular body, the annular body comprising a first conductive chiller, a second conductive chiller, and a heater, positioned between the first conductive chiller and the second conductive chiller along the working axis, the method comprising steps of:

compressing the workpiece along a central axis of the workpiece;

simultaneously with compressing the workpiece along the central axis, twisting the workpiece about the central axis;

while compressing the workpiece along the central axis and twisting the workpiece about the central axis, translating the annular body along the working axis of the high-pressure-torsion apparatus, collinear with the central axis of the workpiece, and heating the workpiece with the heater; and cooling the workpiece with at least one of the first conductive chiller or cooling the workpiece with the second conductive chiller, simultaneously with the step of heating the workpiece with the heater, wherein:

the step of cooling the workpiece with the first conductive chiller comprises steps of routing a first cooling fluid through the first conductive chiller and transferring heat from the workpiece to the first cooling fluid through a thermal conductor of the first conductive chiller; and the step of cooling the workpiece with the second conductive chiller comprises steps of routing a second cooling fluid through the second conductive chiller and transferring heat from the workpiece to the second cooling fluid through a second thermal conductor of the second conductive chiller.

2. The method according to claim 1, wherein the step of routing the first cooling fluid through the first conductive chiller and the step of routing the second cooling fluid through the second conductive chiller are independently controlled, and wherein each of the first cooling fluid and the second cooling fluid is a liquid.

3. The method according to claim 2, wherein:

the annular body comprises a central opening, at least partially formed by the thermal conductor of the first conductive chiller and the second thermal conductor of the second conductive chiller;

the step of transferring heat from the workpiece to the first cooling fluid through the thermal conductor of the first conductive chiller comprises contacting the workpiece, protruding through the central opening with the thermal conductor of the first conductive chiller; and the step of transferring heat from the workpiece to the second cooling fluid through the second thermal conductor of the second conductive chiller comprises contacting the workpiece, protruding through the central opening with the second thermal conductor of the second conductive chiller.

4. The method according to claim 3, wherein:

the first conductive chiller comprises a channel, comprising an inlet, an outlet, and an intermediate portion, which is in fluidic communication with the inlet and the outlet;

the step of transferring heat from the workpiece to the first cooling fluid through the thermal conductor of the first conductive chiller comprises flowing the first cooling fluid from the inlet of the channel, through the intermediate portion of the channel, and into the outlet of the channel; and the thermal conductor fluidically isolates the intermediate portion of the channel from the central opening of the annular body.

5. The method according to claim 3, wherein:

the second conductive chiller comprises a second channel, comprising a second inlet, a second outlet, and a second intermediate portion, which is in fluidic communication with the second inlet and the second outlet;

the step of transferring heat from the workpiece to the second cooling fluid through the second thermal conductor of the second conductive chiller comprises flowing the second cooling fluid from the second inlet of the second channel, through the second intermediate portion of the second channel, and into the second outlet of the second channel; and the second thermal conductor of the second conductive chiller fluidically isolates the second intermediate portion of the second channel from the central opening of the annular body.

6. The method according to claim 1, wherein:

the step of transferring the heat from the workpiece to the first cooling fluid through the thermal conductor of the first conductive chiller comprises a step of flexing the thermal conductor toward the working axis and directly contacting the workpiece with the thermal conductor; and the step of transferring the heat from the workpiece to the second cooling fluid through the second thermal conductor of the second conductive chiller comprises a step of flexing the second thermal conductor toward the working axis and directly contacting the workpiece with the second thermal conductor.

7. The method according to claim 6, wherein:

the step of flexing the thermal conductor toward the working axis comprises routing the first cooling fluid through the first conductive chiller; and the step of flexing the second thermal conductor toward the working axis comprises routing the second cooling fluid through the second conductive chiller.

8. The method according to claim 1, wherein each of the first cooling fluid and the second cooling fluid is a liquid.

9. The method according to claim 5, wherein the second intermediate portion of the second channel has a closed shape and surrounds the working axis.

10. The method according to claim 1, wherein the step of heating the workpiece with the heater is independent from the step of cooling the workpiece with at least one of the first conductive chiller or the second conductive chiller.

11. The method according to claim 10, wherein the step of heating the workpiece with the heater is performed while the workpiece is not cooled by at least one of the first conductive chiller or the second conductive chiller.

12. The method according to claim 1, further comprising thermally conductively isolating the heater from the second conductive chiller from each other using a second thermal barrier while the step of heating the workpiece with the heater is performed simultaneously with the step of cooling the workpiece with the second conductive chiller.

13. The method according to claim 12, wherein the second thermal barrier contacts the workpiece.

14. The method according to claim 1, further comprising:

engaging a first end of the workpiece with the first anvil of the high-pressure-torsion apparatus; and engaging a second end of the workpiece with the second anvil of the high-pressure-torsion apparatus; and wherein the steps of compressing the workpiece along the central axis of the workpiece and twisting the workpiece about the central axis are performed using the first anvil and the second anvil.

15. The method according to claim 14, wherein:

the first anvil comprises a base and a protrusion, extending from the base toward the second anvil along the working axis;

the annular body comprises a central opening; and the step of translating the annular body along the working axis of the high-pressure-torsion apparatus comprises advancing the protrusion of the first anvil into the central opening of the annular body.

16. The method according to claim 15 wherein the step of cooling the workpiece with the first conductive chiller is discontinued while advancing the protrusion of the first anvil into the central opening of the first conductive chiller.

17. A method of modifying material properties of a workpiece using a high-pressure-torsion apparatus, the high-pressure-torsion apparatus comprising a working axis, a first anvil, a second anvil, and an annular body, the annular body comprising a first conductive chiller, a second conductive chiller, and a heater, positioned between the first conductive chiller and the second conductive chiller along the working axis, the method comprising steps of:

compressing the workpiece along a central axis of the workpiece;

simultaneously with compressing the workpiece along the central axis, twisting the workpiece about the central axis;

while compressing the workpiece along the central axis and twisting the workpiece about the central axis, translating the annular body along the working axis of the high-pressure-torsion apparatus, collinear with the central axis of the workpiece, and heating the workpiece with the heater;

cooling the workpiece with at least one of the first conductive chiller or cooling the workpiece with the second conductive chiller, simultaneously with the step of heating the workpiece with the heater; and thermally conductively isolating the heater from the first conductive chiller from each other using a first thermal barrier while the step of heating the workpiece with the heater is performed simultaneously with the step of cooling the workpiece with the first conductive chiller.

18. The method according to claim 17, wherein the first thermal barrier contacts the workpiece.

19. A method of modifying material properties of a workpiece using a high-pressure-torsion apparatus, the high-pressure-torsion apparatus comprising a working axis, a first anvil, a second anvil, and an annular body, the annular body comprising a first conductive chiller, a second conductive chiller, and a heater, positioned between the first conductive chiller and the second conductive chiller along the working axis, the method comprising steps of:

compressing the workpiece along a central axis of the workpiece;

simultaneously with compressing the workpiece along the central axis, twisting the workpiece about the central axis;

while compressing the workpiece along the central axis and twisting the workpiece about the central axis, translating the annular body along the working axis of the high-pressure-torsion apparatus, collinear with the central axis of the workpiece, and heating the workpiece with the heater;

cooling the workpiece with at least one of the first conductive chiller or cooling the workpiece with the second conductive chiller, simultaneously with the step of heating the workpiece with the heater;

receiving, at a controller of the high-pressure-torsion apparatus, input from a heater temperature sensor, a first-chiller temperature sensor, and a second-chiller temperature sensor, and wherein each of the heater temperature sensor, the first-chiller temperature sensor, and the second-chiller temperature sensor is communicatively coupled with the controller; and controlling, using the controller, operations of at least one of the heater, the first conductive chiller, or second conductive chiller based on the input from the heater temperature sensor, the first-chiller temperature sensor, and the second-chiller temperature sensor, and wherein each of the heater, the first conductive chiller, and the second conductive chiller is communicatively coupled with and controlled by the controller.

20. The method according to claim 19, wherein the step of translating the annular body along the working axis of the high-pressure-torsion apparatus is performed using a linear actuator, communicatively coupled to and controlled by the controller.

* * * * *